US011030939B2

(12) United States Patent
Park et al.

(10) Patent No.: US 11,030,939 B2
(45) Date of Patent: Jun. 8, 2021

(54) DISPLAY DEVICE

(71) Applicant: SAMSUNG DISPLAY CO., LTD., Yongin-si (KR)

(72) Inventors: Sehyuk Park, Seongnam-si (KR); Hyojin Lee, Yongin-si (KR); Hui Nam, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/383,436

(22) Filed: Apr. 12, 2019

(65) Prior Publication Data

US 2019/0318685 A1 Oct. 17, 2019

(30) Foreign Application Priority Data

Apr. 12, 2018 (KR) ..... 10-2018-0042599

(51) Int. Cl.
*G09G 3/32* (2016.01)

(52) U.S. Cl.
CPC ..... *G09G 3/32* (2013.01); *G09G 2300/0452* (2013.01); *G09G 2310/027* (2013.01); *G09G 2310/0278* (2013.01); *G09G 2310/0289* (2013.01); *G09G 2310/08* (2013.01); *G09G 2320/0204* (2013.01)

(58) Field of Classification Search
CPC ..... G09G 3/32; G09G 2310/08; G09G 2310/027; G09G 2320/0204; G09G 2300/0452; G09G 2310/0289; G09G 2310/0278; G09G 2370/04; G09G 2320/0233; G09G 2320/0285; G09G 2300/0443; G09G 2300/0852; G09G 2310/0264
See application file for complete search history.

(56) References Cited

U.S. PATENT DOCUMENTS

| | | | | |
|---|---|---|---|---|
| 9,805,651 | B2 | 10/2017 | Kim | |
| 9,964,767 | B2 | 5/2018 | Son et al. | |
| 2009/0309816 | A1* | 12/2009 | Choi | G09G 3/3233 345/76 |
| 2010/0001944 | A1* | 1/2010 | Seong | G09G 3/3648 345/102 |
| 2013/0241962 | A1* | 9/2013 | Cha | G09G 3/003 345/690 |

(Continued)

FOREIGN PATENT DOCUMENTS

| | | |
|---|---|---|
| KR | 10-2015-0144893 | 12/2015 |
| KR | 10-2017-0003210 | 1/2017 |

*Primary Examiner* — Amit Chatly
(74) *Attorney, Agent, or Firm* — Lewis Roca Rothgerber Christie LLP

(57) ABSTRACT

A display device is capable of improving the image quality, the display device including: a display panel; a pixel on the display panel and including at least one light emitting element; a timing controller configured to receive an image data signal of the pixel and to compensate for a gray value of the image data signal based on the number of light emitting elements of the pixel to generate a compensated image data signal; and a data driver configured to select a compensation data signal corresponding to the compensated image data signal from the timing controller and to apply the compensation data signal to the pixel.

17 Claims, 14 Drawing Sheets

(56) References Cited

U.S. PATENT DOCUMENTS

| | | | | |
|---|---|---|---|---|
| 2015/0194107 | A1* | 7/2015 | Bae | G09G 3/3607 345/696 |
| 2015/0357315 | A1* | 12/2015 | Oraw | H01L 25/0753 315/294 |
| 2016/0055797 | A1* | 2/2016 | Tan | G09G 3/3258 345/206 |
| 2017/0069260 | A1* | 3/2017 | Cho | G09G 3/325 |
| 2017/0250168 | A1* | 8/2017 | Do | H01L 25/0753 |

* cited by examiner

| The number of LEDs in a pixel: k-1 | | | |
|---|---|---|---|
| Gray level | Image data signal | Compensated image data signal | Compensation data signal |
| 255 | D_G255 | D_k-1_G255 | A_k-1_G255 |
| 254 | D_G254 | D_k-1_G254 | A_k-1_G254 |
| ⋮ | ⋮ | ⋮ | ⋮ |
| 2 | D_G2 | D_k-1_G2 | A_k-1_G2 |
| 1 | D_G1 | D_k-1_G1 | A_k-1_G1 |
| 0 | D_G0 | D_k-1_G0 | A_k-1_G0 |

FIG. 6B

| The number of LEDs in a pixel: k-2 | | | |
|---|---|---|---|
| Gray level | Image data signal | Compensated image data signal | Compensation data signal |
| 255 | D_G255 | D_k-2_G255 | A_k-2_G255 |
| 254 | D_G254 | D_k-2_G254 | A_k-2_G254 |
| ⋮ | ⋮ | ⋮ | ⋮ |
| 2 | D_G2 | D_k-2_G2 | A_k-2_G2 |
| 1 | D_G1 | D_k-2_G1 | A_k-2_G1 |
| 0 | D_G0 | D_k-2_G0 | A_k-2_G0 |

FIG. 6C

| The number of LEDs in a pixel: k+1 | | | |
|---|---|---|---|
| Gray level | Image data signal | Compensated image data signal | Compensation data signal |
| 255 | D_G255 | D_k+1_G255 | A_k+1_G255 |
| 254 | D_G254 | D_k+1_G254 | A_k+1_G254 |
| ⋮ | ⋮ | ⋮ | ⋮ |
| 2 | D_G2 | D_k+1_G2 | A_k+1_G2 |
| 1 | D_G1 | D_k+1_G1 | A_k+1_G1 |
| 0 | D_G0 | D_k+1_G0 | A_k+1_G0 |

FIG. 6D

| The number of LEDs in a pixel: k+2 | | | |
|---|---|---|---|
| Gray level | Image data signal | Compensated image data signal | Compensation data signal |
| 255 | D_G255 | D_k+2_G255 | A_k+2_G255 |
| 254 | D_G254 | D_k+2_G254 | A_k+2_G254 |
| ⋮ | ⋮ | ⋮ | ⋮ |
| 2 | D_G2 | D_k+2_G2 | A_k+2_G2 |
| 1 | D_G1 | D_k+2_G1 | A_k+2_G1 |
| 0 | D_G0 | D_k+2_G0 | A_k+2_G0 |

FIG. 6E

| The number of LEDs in a pixel: k | | | |
|---|---|---|---|
| Gray level | Image data signal | Compensated image data signal | Compensation data signal |
| 255 | D_G255 | — | A_G255 |
| 254 | D_G254 | — | A_G254 |
| ⋮ | ⋮ | ⋮ | ⋮ |
| 2 | D_G2 | — | A_G2 |
| 1 | D_G1 | — | A_G1 |
| 0 | D_G0 | — | A_G0 |

| Based on CIE 1931 | Chromaticity coordinates of green in gray level 255 | |
|---|---|---|
| The number of LEDs in a pixel | X | Y |
| 5 | 0.149 | 0.657 |
| 4 | 0.143 | 0.573 |
| 3 | 0.138 | 0.448 |
| 2 | 0.134 | 0.366 |
| 1 | 0.129 | 0.287 |

DISPLAY DEVICE

CROSS-REFERENCE TO RELATED APPLICATION

This application claims priority to and the benefit of Korean Patent Application No. 10-2018-0042599, filed on Apr. 12, 2018, in the Korean Intellectual Property Office (KIPO), the disclosure of which is incorporated by reference herein in its entirety.

BACKGROUND

1. Field

Aspects of some example embodiments of the present invention relate to a display device and, for example, to a display device capable of improving image quality.

2. Discussion of Related Art

Light emitting diodes ("LEDs") have relatively high light conversion efficiency, very low energy consumption, are semi-permanent, and are environmentally friendly. Accordingly, the LEDs are utilized in many fields such as traffic lights, mobile phones, automobile headlights, outdoor electric signboards, backlights, and indoor/outdoor lights.

Recently, display devices utilizing nano-sized LEDs as the light emitting elements have been studied.

Nano-LEDs are generally deposited on a substrate through an ink printing method, in which case, however, it is difficult to deposit the same number of nano-LEDs in each pixel. Accordingly, the number of LEDs deposited in each pixel becomes different, and thus the driving current applied to each LED in each pixel may be different and the image quality may be degraded.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Aspects of some example embodiments of the present invention may include a display device capable of improving the image quality.

According to some example embodiments, a display device includes: a display panel; a pixel on the display panel, the pixel including at least one light emitting element; a timing controller configured to receive an image data signal of the pixel and to compensate for a gray value of the image data signal based on the number of light emitting elements of the pixel to generate a compensated image data signal; and a data driver configured to select a compensation data signal corresponding to the compensated image data signal from the timing controller and to apply the compensation data signal to the pixel.

As the number of light emitting elements of the pixel is smaller, the compensated image data signal may have a smaller gray value.

The timing controller may compare the number of light emitting elements of the pixel with a predetermined reference value, and generate the compensated image data signal based on the comparison result.

When the number of light emitting elements of the pixel is less than the reference value, the compensated image data signal may have a gray value less than that of the image data signal.

As a difference between the number of light emitting elements of the pixel and the reference value is greater, the compensated image data signal may have a smaller gray value.

When the number of light emitting elements of the pixel is greater than the reference value, the compensated image data signal may have a gray value greater than that of the image data signal.

As a difference between the number of light emitting elements of the pixel and the reference value is greater, the compensated image data signal may have a greater gray value.

The display device may further include a look-up table in which the number of light emitting elements of the pixel is stored.

At least one of the light emitting elements may be a nano-light emitting element.

The compensation data signal from the data driver may be applied to the pixel through a data line of the display panel.

The pixel may include: a first switching element including a gate electrode connected to a gate line of the display panel, the first switching element being connected between the data line and a node; a second switching element including a gate electrode connected to the node, the second switching element being connected between a first driving power line of the display panel and a first electrode of the light emitting element; and a capacitor connected between the node and the first driving power line.

A second electrode of the light emitting element may be connected to a second driving power line of the display panel.

According to some example embodiments, a display device includes: a display panel including a pixel connected to a first driving power line, a second driving power line, a data line, and a first compensation line; and a driving circuit configured to generate a first compensation voltage based on the number of light emitting elements of the pixel, and to apply the first compensation voltage to the first compensation line. The pixel includes: a driving switching element receiving a data signal from the data line; at least one light emitting element connected to the driving switching element; and a first compensation switching element including a gate electrode connected to the first compensation line, the first compensation switching element being connected between the first driving power line and the driving switching element.

As the number of light emitting elements of the pixel is smaller, the first compensation voltage may have a smaller value.

The driving circuit may compare the number of light emitting elements of the pixel with a predetermined reference value, and generate the first compensation voltage based on the comparison result.

When the number of light emitting elements of the pixel is less than the reference value, the first compensation voltage may have a value less than that of a predetermined reference compensation voltage.

As a difference between the number of light emitting elements of the pixel and the reference value is greater, the first compensation voltage may have a smaller value.

When the number of light emitting elements of the pixel is greater than the reference value, the first compensation voltage may have a value greater than that of a predetermined reference compensation voltage.

According to some example embodiments, a display device includes: a display panel including a pixel connected to a first driving power line, a second driving power line, a data line, and a first compensation line; and a driving circuit configured to generate a first compensation voltage based on the number of light emitting elements of the pixel, and to apply the first compensation voltage to the first compensation line. The pixel includes: a driving switching element receiving a data signal from the data line; at least one light emitting element connected to the driving switching element; and a first compensation switching element including a gate electrode connected to the first compensation line, the first compensation switching element being connected between the light emitting element and the second driving power line.

As the number of light emitting elements of the pixel is smaller, the first compensation voltage may have a smaller value.

The foregoing is illustrative only and is not intended to be in any way limiting. In addition to the illustrative aspects, embodiments and features described above, further aspects, embodiments and features will become more apparent by reference to the drawings and the following detailed description.

BRIEF DESCRIPTION OF THE DRAWINGS

A more complete appreciation of the present invention will become more apparent by describing in more detail aspects of some example embodiments thereof with reference to the accompanying drawings, wherein:

FIG. 5 is a detailed view illustrating one of light emitting diodes ("LEDs") in FIG. 3;

FIGS. 6A to 6E are views for explaining the magnitude of a compensation data signal according to the number of LEDs included in a pixel;

DETAILED DESCRIPTION

Figure 1:
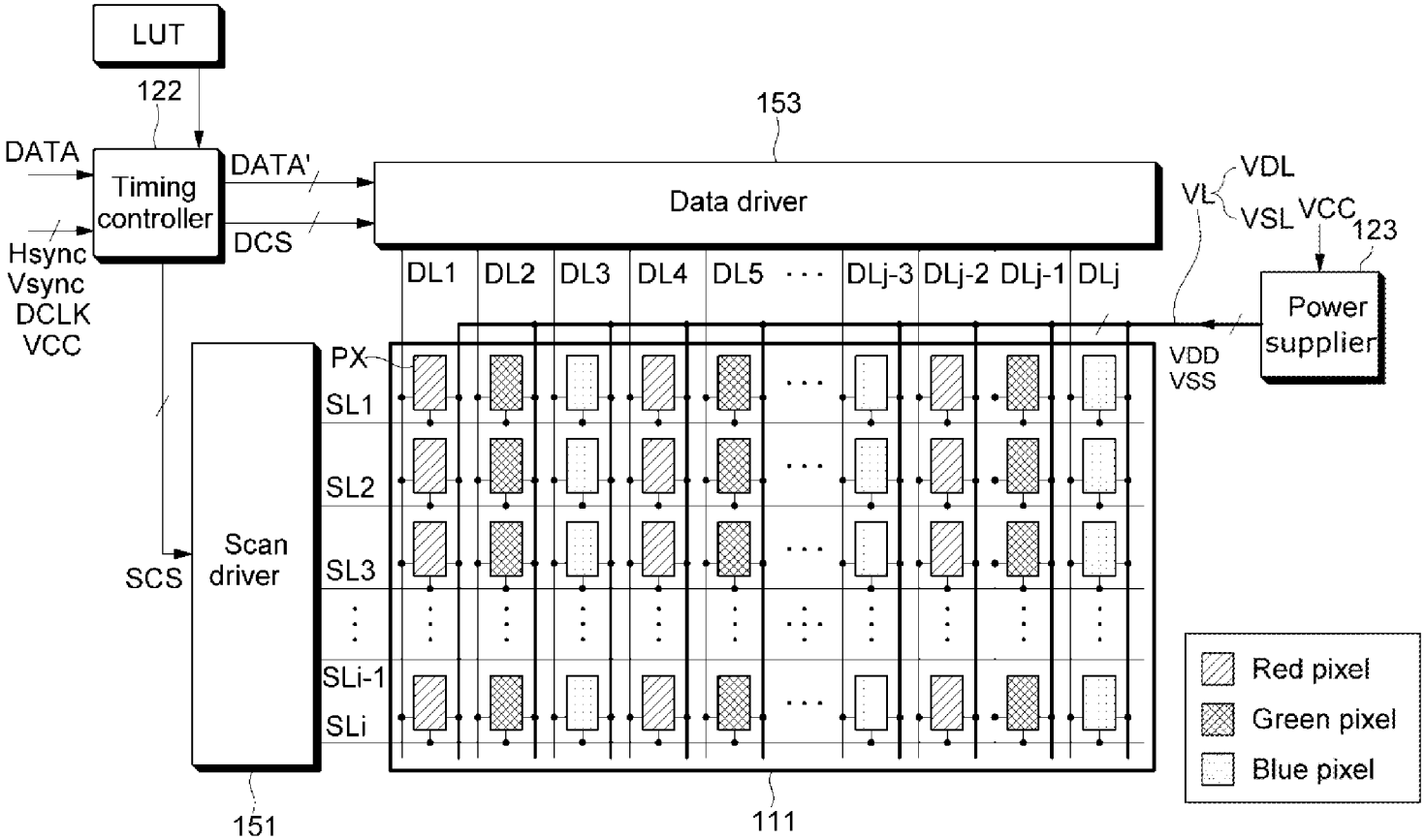
FIG. 1 is a view illustrating a display device according to some example embodiments of the present invention.

Aspects of some example embodiments will now be described more fully hereinafter with reference to the accompanying drawings. Although the invention may be modified in various manners and have several embodiments, embodiments are illustrated in the accompanying drawings and will be mainly described in the specification. However, the scope of the invention is not limited to the embodiments and should be construed as including all the changes, equivalents and substitutions included in the spirit and scope of the invention.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "lower", "above", "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device located "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "including," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of variation for the particular value as determined by one of ordinary skill in the art, considering the measurement in question and the error associated with measurement of the particular quantity (i.e., the limitations of the measurement system). For example, "about" may mean within one or more standard variations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Like reference numerals refer to like elements throughout the specification.

Hereinafter, a display device according to some example embodiments of the present invention will be described with reference to FIGS. 1 to 13.

FIG. 1 is a view illustrating a display device according to some example embodiments of the present invention.

A display device according to some example embodiments of the present invention includes a display panel 111, a scan driver 151, a data driver 153, a timing controller 122, a look-up table LUT, and a power supplier 123, as illustrated in FIG. 1.

The display panel 111 includes a plurality of pixels PX; and a plurality of scan lines SL1 to SLi, a plurality of data lines DL1 to DLj, and a power line VL for transmitting various signals required for the pixels PX to display images, where "i" is a natural number greater than 2 and "j" is a natural number greater than 3. The power line VL includes a first driving power line VDL and a second driving power line VSL which are electrically separated from each other.

The pixels PX are arranged at the display panel 111 in a matrix form.

Each pixel PX includes at least one light emitting diode ("LED").

At least two of the entire pixels (e.g., "i*j" number of pixels) may include different numbers of LEDs. For example, if one pixel includes five LEDs, another pixel may include one LED.

The pixels PX include a red pixel for displaying red, a green pixel for displaying green and a blue pixel for displaying blue.

The red pixel includes at least one red LED emitting red light, the green pixel includes at least one green LED emitting green light, and the blue pixel includes at least one blue LED emitting blue light. In one example embodiment, one pixel does not necessarily include at least one LED. For example, each of the red pixel, the green pixel, and the blue pixel may include a red LED and a blue LED. In such an example embodiment, the red pixel, the green pixel, and the blue pixel may further include color conversion layers located on the LED.

In the look-up table LUT, information on the number of LEDs included in each pixel PX is pre-stored. For example, information on the number of LEDs included in each of the "i*j" number of pixels PX may be stored in advance in this look-up table LUT.

Information on the number of LEDs of each pixel PX may be obtained, for example, through a photograph taken by a camera or a current detected from each pixel PX of the display panel 111. The greater the number of LEDs of the pixel PX, the higher the current detected from the pixel PX.

A system located outside the display panel 111 outputs a vertical synchronization signal Vsync, a horizontal synchronization signal Hsync, a clock signal DCLK, a power signal VCC, and image data signal DATA through an interface circuit by using a low voltage differential signaling (LVDS) transmitter of a graphic controller. The vertical synchronization signal Vsync, the horizontal synchronization signal Hsync, the clock signal DCLK, and the power signal VCC output from the system are applied to the timing controller 122. In addition, the image data signals DATA sequentially output from the system are applied to the timing controller 122.

The timing controller 122 compensates for each of the image data signals DATA of the pixels PX applied from the system to generate compensated image data signals DATA', and apply the compensated image data signals DATA' to the data driver 153. In some example embodiments, the timing controller 122 may compensate for the image data signal of the corresponding pixel based on the number of LEDs included in the corresponding pixel. For example, the timing controller 122 may identify the number of LEDs of the corresponding pixel based on the information provided from the look-up table LUT, and compensate for the image data signal of the corresponding pixel based on the number of LEDs.

The timing controller 122 generates a data control signal DCS and a scan control signal SCS based on the horizontal synchronization signal Hsync, the vertical synchronization signal Vsync, and the clock signal DCLK input to the timing controller 122 and outputs the data control signal DCS and the scan control signal SCS to the data driver 153 and the scan driver 151, respectively. The data control signal DCS is applied to the data driver 153 and the scan control signal SCS is applied to the scan driver 151.

The data control signal DCS includes a dot clock, a source shift clock, a source enable signal and a polarity inversion signal.

The scan control signal SCS includes a gate start pulse, a gate shift clock and a gate output enable signal.

The data driver 153 samples the compensated image data signals DATA' according to the data control signal DCS from the timing controller 122, latches the sampled image data signals corresponding to one horizontal line in each horizontal time (1H, 2H, . . . ), and applies the latched image data signals to the data lines DL1 to DLj. For example, the data driver 153 converts the compensated image data signal DATA' applied from the timing controller 122 into an analog signal using a gamma voltage input from the power supplier 123, and applies the analog signals to the data lines DL1 to DLj.

The scan driver 151 includes a shift register that generates scan signals in response to the gate start pulse in the scan control signal SCS applied from the timing controller 122 and a level shifter that shifts the scan signals to a voltage level suitable for driving the pixel PX. The scan driver 151 applies first to i-th scan signals to the scan lines SL1 to SLi, respectively, in response to the scan control signal SCS applied from the timing controller 122.

The power supplier 123 generates the plurality of gamma voltage, a first driving voltage VDD, and a second driving voltage VSS. The power supplier 123 applies the plurality of gamma voltage to the data driver 153, applies the first driving voltage VDD to the first driving power line VDL, and applies the second driving voltage VSS to the second driving power line VSL.

Figure 2:
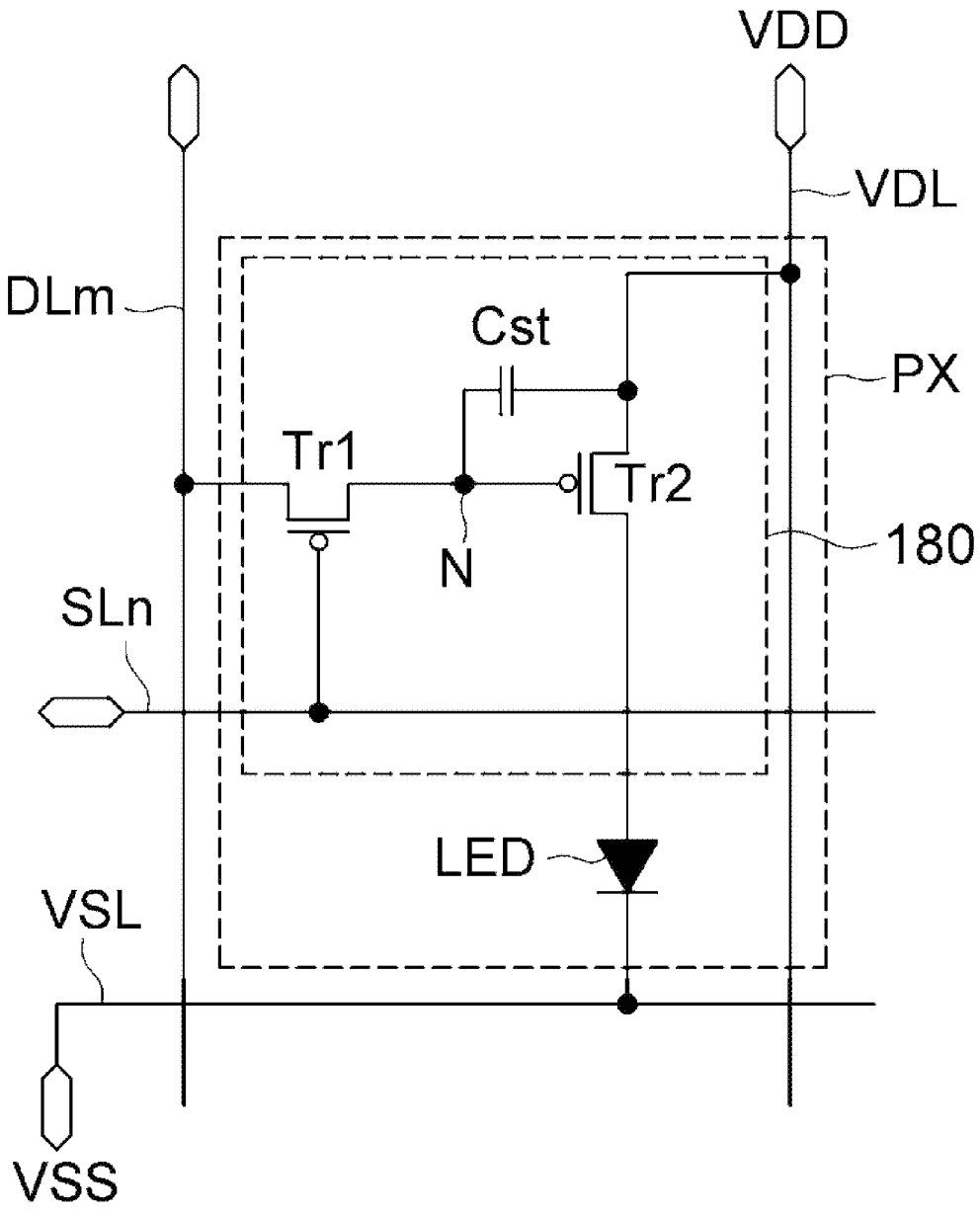
FIG. 2 is a circuit diagram of one of pixels illustrated in FIG. 1.

FIG. 2 is a circuit diagram illustrating one of pixels in FIG. 1.

A pixel PX includes a pixel circuit 180 and an LED receiving a driving current from the pixel circuit 180, as illustrated in FIG. 2.

The pixel circuit 180 may include a first switching element Tr1, a second switching element Tr2, and a storage capacitor Cst.

The first switching element Tr1 includes a first gate electrode connected to an n-th scan line SLn, and is connected between an m-th data line DLm and a node N. One of a first drain electrode and a first source electrode of the first switching element Tr1 is connected to the m-th data line DLm, and the other of the first drain electrode and the first source electrode of the first switching element Tr1 is connected to the node N. For example, the first source electrode of the first switching element Tr1 is connected to the m-th data line DLm, and the first drain electrode of the first switching element Tr1 is connected to the node N, where m is a natural number.

The second switching element Tr2 includes a second gate electrode connected to the node N, and is connected between the first driving power line VDL and the LED. One of a second drain electrode and a second source electrode of the second switching element Tr2 is connected to the first driving power line VDL, and the other of the second drain electrode and the second source electrode of the second switching element Tr2 is connected to the LED. For example, the second source electrode of the second switching element Tr2 is connected to the first driving power line VDL, and the second drain electrode of the second switching element Tr2 is connected to the LED.

The second switching element Tr2 is a driving switching element for driving the LED, and the second switching element Tr2 adjusts an amount (density) of the driving current applied from the first driving power line VDL to the second driving power line VSL according to the magnitude of the data signal applied to the second gate electrode of the second switching element Tr2.

The storage capacitor Cst is connected between the node N and the first driving power line VDL. The storage capacitor Cst stores the signal applied to the second gate electrode of the second switching element Tr2 for one frame period.

The LED is connected between the second drain electrode of the second switching element Tr2 and the second driving power line VSL. The LED emits light in accordance with the driving current applied through the second switching element Tr2. The LED emits light of different brightness depending on the magnitude of the driving current.

Figure 3:
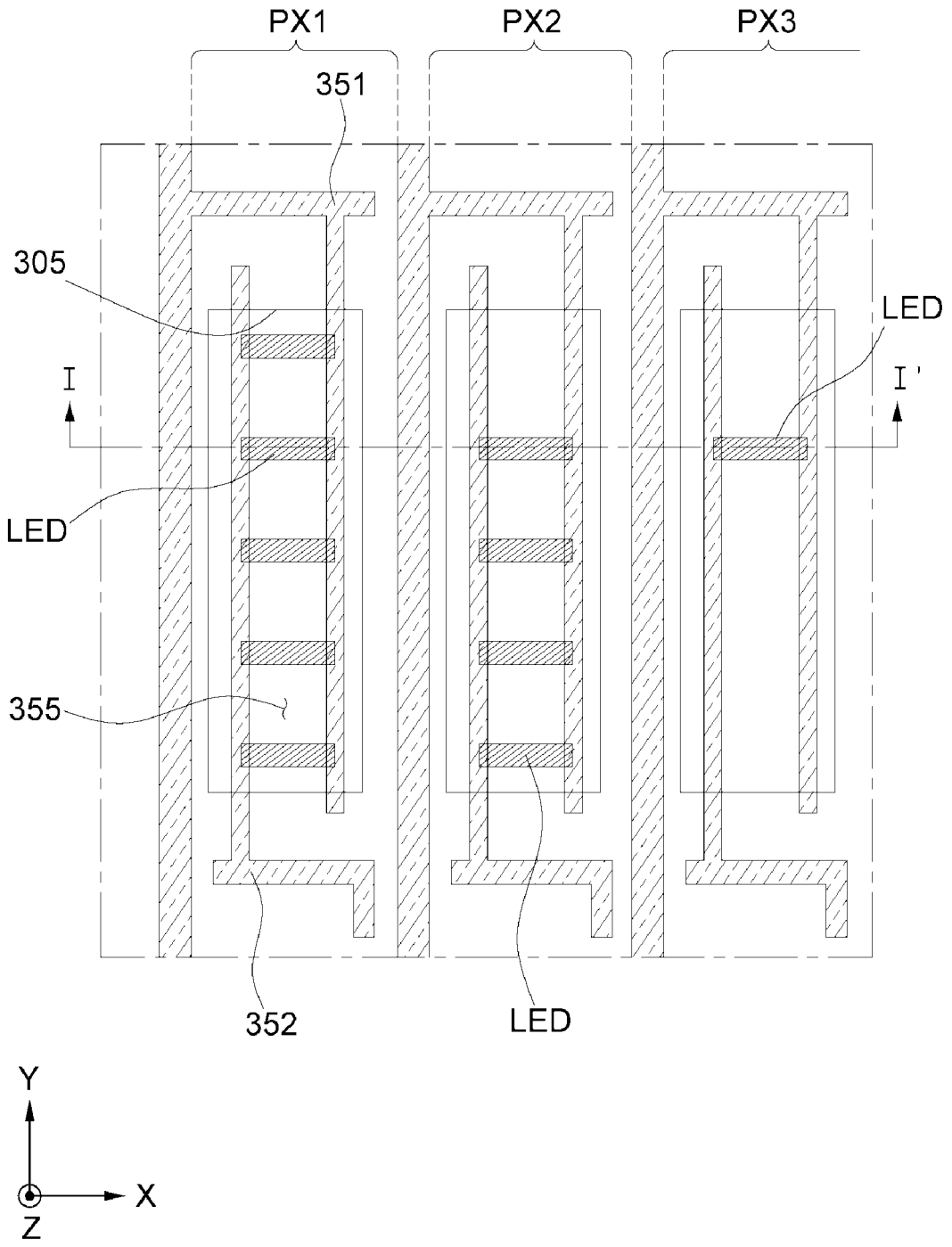
FIG. 3 is a plan view illustrating three adjacent pixels in FIG. 1.
Figure 4:
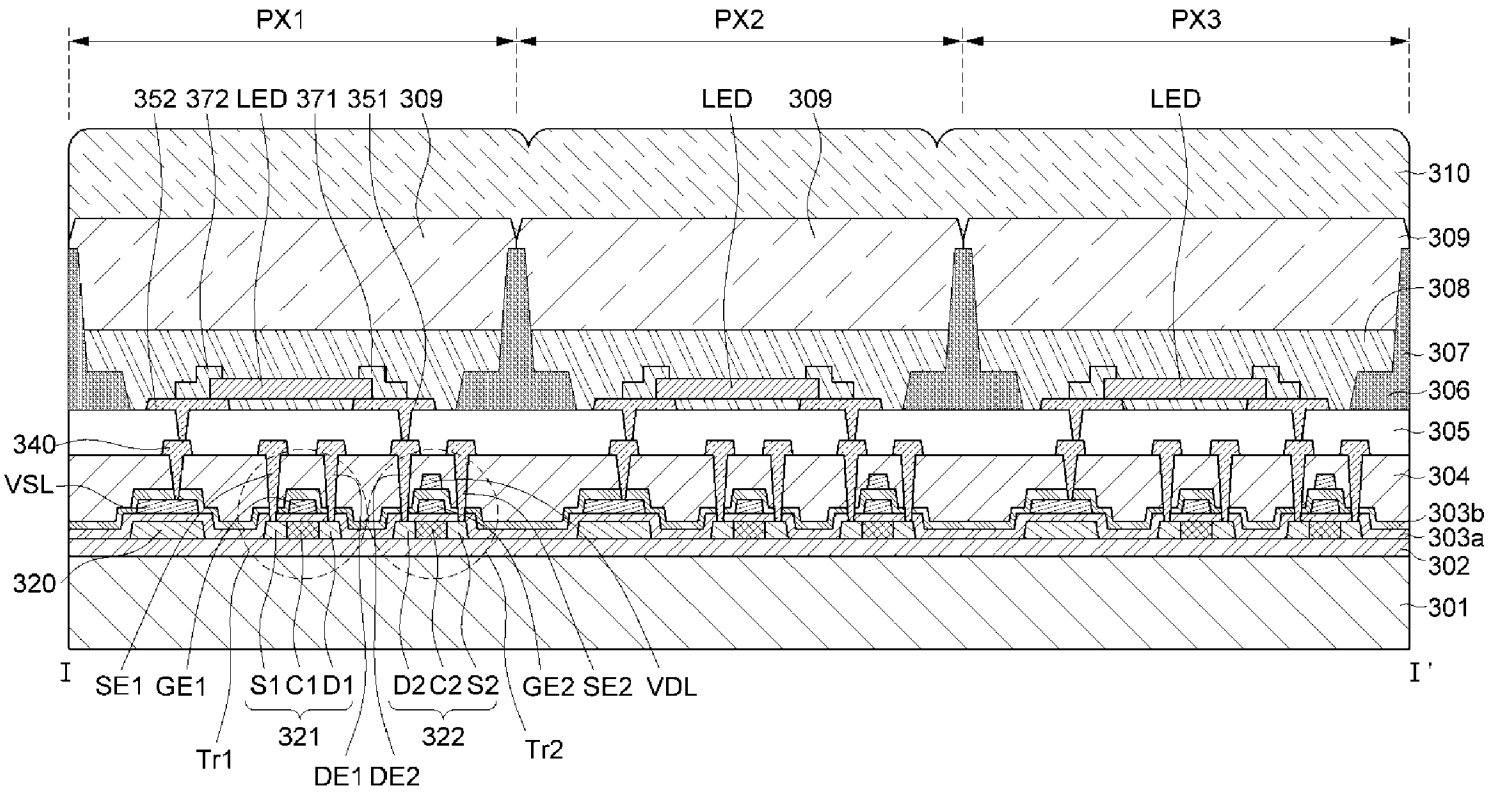
FIG. 4 is a cross-sectional view taken along line I-I' in FIG. 3.

FIG. 3 is a plan view illustrating three adjacent pixels in FIG. 1, and FIG. 4 is a cross-sectional view taken along the line I-I' in FIG. 3.

As illustrated in FIGS. 3 and 4, a display device includes a substrate 301, a buffer layer 302, a first gate insulating layer 303*a*, a second gate insulating layer 303*b*, an insulating interlayer 304, a planarization layer 305, a first switching element Tr1, a second switching element Tr2, and a dummy layer 320.

The first switching element Tr1 includes a first semiconductor layer 321, a first gate electrode GE1, a first source electrode SE1, and a first drain electrode DE1.

The second switching element Tr2 includes a second semiconductor layer 322, a second gate electrode GE2, a second source electrode SE2, and a second drain electrode DE2.

The buffer layer 302 is located on the substrate 301. The buffer layer 302 overlaps the entire surface of the substrate 301.

The first semiconductor layer 321, the second semiconductor layer 322, and the dummy layer 320 are located on the buffer layer 302.

The first gate insulating layer 303*a* is located on the first semiconductor layer 321, the second semiconductor layer 322 and the buffer layer 302. The first gate insulating layer 303*a* overlaps the entire surface of the substrate 301.

The first gate electrode GE1, the second gate electrode GE2, and the second driving power line VSL are located on the first gate insulating layer 303*a*. In such an example embodiment, the first gate electrode GE1 is located on the first gate insulating layer 303*a* so as to overlap a channel area C1 of the first semiconductor layer 321, the second gate electrode GE2 is located on the first gate insulating layer 303*a* so as to overlap a channel area C2 of the second semiconductor layer 322, and the second driving power line VSL is located on the first gate insulating layer 303*a* so as to overlap the dummy layer 320.

The second gate insulating layer 303*b* is located on the first gate electrode GE1, the second gate electrode GE2, the second driving power line VSL and the first gate insulating layer 303*a*. The second gate insulating layer 303*b* overlaps the entire surface of the substrate 301.

The first driving power line VDL is located on the second gate insulating layer 303*b*. The first driving power line VDL is located on the second gate insulating layer 303*b* so as to overlap the second gate electrode GE2. The storage capacitor Cst is located between the first driving power line VDL and the second gate electrode GE2.

The insulating interlayer 304 is located on the first driving power line VDL and the second gate insulating layer 303*b*. The insulating interlayer 304 overlaps the entire surface of the substrate 301.

The first source electrode SE1, the first drain electrode DE1, the second source electrode SE2, the second drain electrode DE2 and a connection electrode 340 are located on the insulating interlayer 304.

The first source electrode SE1 is connected to a first source area S1 of the first semiconductor layer 321 through a first source contact hole defined through the insulating interlayer 304, the second gate insulating layer 303*b*, and the first gate insulating layer 303*a*.

The first drain electrode DE1 is connected to a first drain area D1 of the first semiconductor layer 321 through a first drain contact hole defined through the insulating interlayer 304, the second gate insulating layer 303*b* and the first gate insulating layer 303*a*. The first drain electrode DE1 is connected to the second gate electrode GE2 through a contact hole defined through the insulating interlayer 304 and the second gate insulating layer 303*b*.

The second source electrode SE2 is connected to a second source area S2 of the second semiconductor layer 322 through a second source contact hole defined through the insulating interlayer 304, the second gate insulating layer 303*b* and the first gate insulating layer 303*a*. The second source electrode SE2 is connected to the first driving power line VDL through a contact hole defined through the insulating interlayer 304.

The second drain electrode DE2 is connected to a second drain area D2 of the second semiconductor layer 322 through a second drain contact hole defined through the insulating interlayer 304, the second gate insulating layer 303*b* and the first gate insulating layer 303*a*.

The connection electrode 340 is connected to the second driving power line VSL through a contact hole defined through the insulating interlayer 304 and the second gate insulating layer 303*b*.

The planarization layer 305 is located on the first source electrode SE1, the first drain electrode DE1, the second source electrode SE2, the second drain electrode DE2, the connection electrode 340, and the insulating interlayer 304.

A first electrode unit 351 and a second electrode unit 352 are located on the planarization layer 305.

The first electrode unit 351 is connected to the second drain electrode DE2 through a first contact hole defined through the planarization layer 305.

The second electrode unit 352 is connected to the connection electrode 340 through a second contact hole defined through the planarization layer 305. The second electrode unit 352 is connected to the second driving power line VSL through the connection electrode 340.

The LED is located on the first electrode unit 351, the second electrode unit 352, and the planarization layer 305. For example, a first electrode of the LED is located on the first electrode unit 351, and a second electrode of the LED is located on the second electrode unit 352. The first electrode of the LED is connected to the first electrode unit 351, and the second electrode of the LED is connected to the second electrode unit 352.

The first pixel PX1, the second pixel PX2, and the third pixel PX3 may include LEDs that emit light of different colors, respectively. For example, the LED of the first pixel PX1 may be a red LED that emits red light, the LED of the second pixel PX2 may be a green LED that emits green light, and the LED of the third pixel PX3 may be a blue LED that emits blue light.

As illustrated in FIG. 3, the first, second, and third pixels PX1, PX2, and PX3 may respectively include different numbers of LEDs. For example, the first pixel PX1 may include five LEDs, the second pixel PX2 may include four LEDs, and the third pixel PX3 may include one LED.

A first contact electrode 371 is located on the first electrode unit 351 and the first electrode of the LED. The first contact electrode 371 is connected to the first electrode unit 351 and the first electrode of the LED.

A second contact electrode 372 is located on the second electrode unit 352 and the second electrode of the LED. The second contact electrode 372 is connected to the second electrode unit 352 and the second electrode of the LED.

A light shielding layer 306 is located on the planarization layer 305. The light shielding layer 306 has an opening 355 that defines a pixel area. The aforementioned LED is located in this pixel area.

A spacer 307 is located on the light shielding layer 306. The width of the spacer 307 is less than the width of the light shielding layer 306, and the thickness of the spacer 307 is larger than the thickness of the light shielding layer 306. The width of the spacer 307 and the width of the light shielding layer 306 mean the size in the X-axis direction, and the thickness of the spacer 307 and the thickness of the light shielding layer 306 mean the size in the Z-axis direction.

The protective layer 308 is located on the light shielding layer 306, the LED, the first electrode unit 351, the second electrode unit 352, the first contact electrode 371, the second contact electrode 372, and the planarization layer 305.

An antireflection layer 309 is located on the protective layer 308 and the spacer 307. The antireflection layer 309 prevents (or substantially prevents) reflection of light incident to the display device from the outside.

The first pixel PX1, the second pixel PX2, and the third pixel PX3 may include anti-reflection layers 309 of different colors. For example, the antireflection layer 309 of the first pixel PX1 may be a red antireflection layer that prevents (or reduces) reflection of red light, the antireflection layer 309 of the second pixel PX2 may be a green antireflection layer that prevents (or reduces) reflection of green light, and the antireflection layer 309 of the third pixel PX3 may be a blue antireflection layer that prevents (or reduces) reflection of blue light.

An encapsulation layer 310 is located on the antireflection layer 309 and the spacer 307. The encapsulation layer 310 overlaps the entire surface of the substrate 301.

Figures 5, 6A:
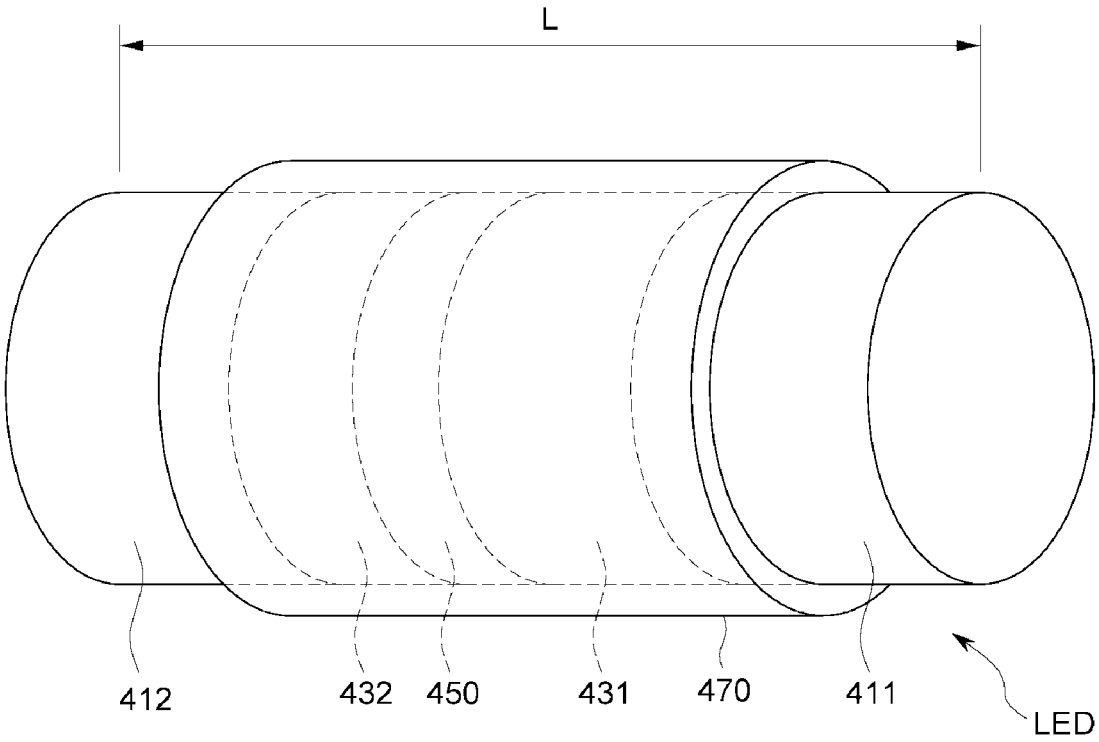

FIG. 5 is a detailed view illustrating one of LEDs in FIG. 3.

The LED is a light emitting element having a length of, for example, a nanometer or a micrometer. The LED may have a cylindrical shape as illustrated in FIG. 5. Although not illustrated, the LED may have a quadrangular parallelepiped shape or various other shapes.

The LED may include a first electrode 411, a second electrode 412, a first semiconductor layer 431, a second semiconductor layer 432, and an active layer 450. In an example embodiment, the LED may further include an insulating layer 470 in addition to the components 411, 412, 431, 432, and 450 described above. At least one of the first electrode 411 and the second electrode 412 may be omitted.

The first semiconductor layer 431 is located between the first electrode 411 and the active layer 450.

The active layer 450 is located between the first semiconductor layer 431 and the second semiconductor layer 432.

The second semiconductor layer 432 is located between the active layer 450 and the second electrode 412.

The insulating layer 470 may have a ring shape surrounding a part of the first electrode 411, a part of the second electrode 412, the first semiconductor layer 431, the active layer 450 and the second semiconductor layer 432. As another example, the insulating layer 470 may have a ring shape surrounding only the active layer 450. The insulating layer 470 prevents (or substantially prevents) contact between the active layer 450 and the first electrode unit 351 and contact between the active layer 450 and the second electrode unit 352. In addition, the insulating layer 470 may prevent (or substantially prevent) the luminous efficiency of the LED from being degraded by protecting the outer surface including the active layer 450.

The first electrode 411, the first semiconductor layer 431, the active layer 450, the second semiconductor layer 432 and the second electrode 412 are sequentially stacked along the longitudinal direction of the LED. As used herein, the length of the LED means the size in the X-axis direction. For example, the length L of the LED may be in the range from about 2 μm to about 5 μm.

The first and second electrodes 411 and 412 may be ohmic contact electrodes. However, the first and second electrodes 411 and 412 are not limited thereto, and may be a Schottky contact electrode.

The first and second electrodes 411 and 412 may include a conductive metal. For example, the first and second electrodes 411 and 412 may include one or more metallic materials of aluminum, titanium, indium, gold and silver. In addition, the first and second electrodes 411 and 412 may include indium tin oxide (ITO) or indium zinc oxide (IZO). The first and second electrodes 411 and 412 may include substantially the same material. Alternatively, the first and second electrodes 411 and 412 may include different materials from each other.

The first semiconductor layer 431 may include, for example, an n-type semiconductor layer. As an example, when the LED is a blue LED, the n-type semiconductor layer may include a semiconductor material having the composition formula of $In_xAl_yGa_{1-x-y}N$, where $0 \le x \le 1$, $0 \le y \le 1$, and $0 \le x+y \le 1$, e.g., one or more of InAlGaN, GaN, AlGaN, InGaN, AlN, InN, or the like. The n-type semiconductor material may be doped with a first conductive dopant (e.g., Si, Ge, Sn, etc.).

The LED having a different color other than the aforementioned blue LED may include another kind of III-V semiconductor material as the n-type semiconductor layer.

The first electrode 411 may be omitted. When the first electrode 411 is not present, the first semiconductor layer 431 may be connected to the first electrode unit 351.

The second semiconductor layer 432 may include, for example, a p-type semiconductor layer. As an example, when the LED is a blue LED, the p-type semiconductor layer may include a semiconductor material having the composition formula of $In_xAl_yGa_{1-x-y}N$, where $0 \le x \le 1$, $0 \le y \le 1$, and $0 \le x+y \le 1$, e.g., one or more of InAlGaN, GaN, AlGaN, InGaN, AlN, InN, or the like. The p-type semiconductor material may be doped with a second conductive dopant (e.g., Mg.).

The second electrode 412 may be omitted. When the second electrode 412 is not present, the second semiconductor layer 432 may be connected to the second electrode unit 352.

The active layer 450 may have a single or multiple quantum well structure. For example, a cladding layer doped with a conductive dopant may be located at at least one of the upper and lower sides of the active layer 450. The cladding layer (that is, the cladding layer including the conductive dopant) may be an AlGaN layer or an InAlGaN layer. In addition to this, a material such as AlGaN or AlInGaN may be used as the active layer 450. When an electric field is applied to the active layer 450, light is generated by coupling of electron-hole pairs. The position of the active layer 450 may be variously changed depending on the type of the LED.

An active layer of an LED having a different color other than the aforementioned blue LED may include another kind of III-V semiconductor material.

The LED may further include at least one of a phosphor layer, an active layer, a semiconductor layer, and an electrode above or below the first and second semiconductor layers 431 and 432.

As illustrated in FIG. 3, when the first, second, and third pixels PX1, PX2 and PX3 respectively include different numbers of LEDs, the magnitudes of the driving currents applied to the LED of the first pixel PX1 (hereinafter, "a first LED"), the LED of the second pixel PX2 (hereinafter, "a second LED"), and the LED of the third pixel PX3 (hereinafter, "a third LED") become different with respect to substantially the same data voltage (e.g., the data voltage corresponding to the image data signal). That is, the driving current applied to the third LED in the smallest number has the highest level as compared to other driving currents. In other words, when the driving current is divided to be applied to the plurality of LEDs, the divided current may be defined as a unit driving current, and the unit driving current applied to the third LED is the largest.

In the case where the first, second, and third LEDs are all green LEDs emitting green light, the third LED receiving the largest driving current may emit blue light rather than green light. For example, when a data signal corresponding to the image data signal of the highest gray level, for example, the gray level 255, (hereinafter, "a data signal of the highest gray level") is applied to the third pixel PX3, the third LED may emit blue light by a large driving current generated by the data signal of the highest gray level In some example embodiments, because the driving current generated by the data signal of the highest gray level is divided to be applied to five first LEDs in the first pixel PX1, the unit driving current applied to each of the five first LEDs is relatively small. Accordingly, each of the first LEDs may emit the green light normally.

In some example embodiments, because the driving current generated by the data signal of the highest gray level is divided to be applied to four second LEDs in the second pixel PX2, the unit driving current applied to each of the four second LEDs is relatively large. Accordingly, the second LED may emit light closer to blue than the first LED.

Even when all of the first, second, and third LEDs described above are red LEDs emitting red light, the second and third LEDs may emit light of a different color rather than red due to the difference in magnitude of the driving current described above.

Similarly, even when all of the first, second, and third LEDs described above are blue LEDs emitting blue light, the second and third LEDs may emit light of a different color rather than blue due to the difference in magnitude of the driving current described above.

The timing controller 122 according to some example embodiments of the present invention may prevent (or substantially prevent) image quality degradation due to the above color distortion by compensating for the image data signal of the pixel PX based on the number of LEDs included in the pixel PX, which will be described in more detail with reference to FIGS. 6A to 6E.

Figure 7:
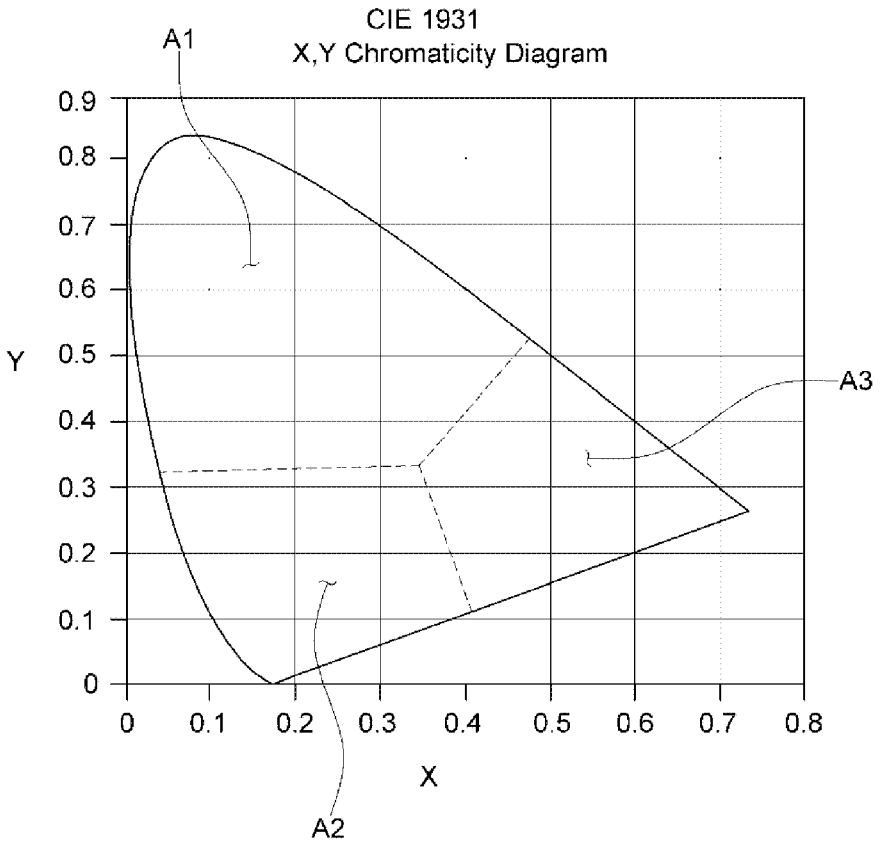
FIG. 7 is a view for explaining color distortion of light according to the number of LEDs of a green pixel.

FIGS. 6A to 6E are views for explaining the magnitude of a compensation data signal according to the number of LEDs included in a pixel, and FIG. 7 is a view for explaining color distortion of light according to the number of LEDs of a green pixel.

Referring to FIGS. 6A to 6C, the image data signal may have a magnitude corresponding to one of a plurality of predetermined gray levels. For example, the image data signal may have a magnitude corresponding to one of 256 gray levels. In other words, the image data signal may have a magnitude corresponding to one gray level in the range from gray level 0 (i.e., the lowest gray level) to gray level 255 (i.e., the highest gray level).

The image data signals from the gray level 0 to the gray level 255 are image data signals representing different brightnesses. For example, the image data signal of the gray level 0 means the image data signal of the darkest gray level (e.g., full black gray level), and the image data signal of the gray level 255 is the image data signal of the brightest gray level (e.g., full white gray level). In other words, the image data signal of a relatively higher gray level is a relatively brighter image data signal.

In FIGS. 6A to 6E, an image data signal D_Gp denotes an image data signal of a gray level p, where p may be, e.g., one of the gray level 0 to the gray level 255. For example, the image data signal D_G255 in FIG. 6A means an image data signal of the gray level 255. When the number of gray levels is greater than 256, the maximum value of p may be greater than 255.

The image data signals have different gray values depending on the gray level. For example, the higher the gray level of the image data signal, the greater the gray value of the image data signal. For example, in FIG. 6A, the image data signal D_G255 of the gray level 255 has a greater gray value than that of the image data signal D_G254 of the gray level 254.

Depending on the type of the driving switching element, the voltage (i.e., digital voltage) of the image data signal may gradually increase or gradually decrease in proportion to the gray value of the image data signal. For example, as illustrated in FIG. 2, when the second switching element Tr2 of the pixel is a P-type transistor, the greater the gray value of the image data signal, the lower the voltage of the image data signal. For example, when the second switching element Tr2 of the above-described pixel is a P-type transistor, the image data signal D_G255 of the gray level 255 in FIG. 6A may have a voltage lower than that of the image data signal D_G254 of the gray level 254. On the other hand, when the second switching element Tr2 of the pixel is an N-type transistor, the greater the gray value of the image data signal, the higher the voltage of the image data signal. For example, when the second switching element Tr2 of the above-described pixel is an N-type transistor, the image data signal D_G255 of the gray level 255 in FIG. 6A may have a voltage higher than that of the image data signal D_G254 of the gray level 254.

In FIGS. 6A to 6D, D_q_Gp denotes a compensated image data signal for an image data signal of the gray level "p" including "q" number of LEDs, where q is a natural number and may be one of k, k−1, k−2, k+1 and k+2 to be described later. For example, the compensated image data signal D_k−1_G255 of FIG. 6A means a compensated image data signal for the image data signal D_G255 of the gray level 255 of a pixel including "k−1" number of LEDs.

The compensated image data signals have different gray values depending on the gray level. For example, the higher the gray level of the compensated image data signal, the greater the gray value of the compensated image data signal. For example, in FIG. 6A, the compensated image data signal D_n−1_G255 of the gray level 255 has a greater gray value than that of the compensated image data signal D_n−1_G254 of the gray level 254.

Depending on the type of the driving switching element, the voltage (i.e., the digital voltage) of the compensated image data signal may gradually increase or gradually decrease in proportion to the gray value of the compensated image data signal. For example, as illustrated in FIG. 2, when the second switching element Tr2 of the pixel is a P-type transistor, the greater the gray value of the compensated image data signal, the lower the voltage of the compensated image data signal. For example, when the second switching element Tr2 of the pixel described above is a P-type transistor, the compensated image data signal D_k−1_G255 of the gray level 255 in FIG. 6A may have a voltage lower than that of the compensated image data signal D_k−1_G254 of the gray level 254.

On the other hand, when the second switching element Tr2 of the pixel described above is an N-type transistor, the greater the gray value of the compensated image data signal, the higher the voltage of the compensated image data signal. For example, when the second switching element Tr2 of the pixel described above is an N-type transistor, the compensated image data signal D_k−1_G255 of the gray level 255 in FIG. 6A may have a voltage higher than that of the compensated image data signal D_k−1_G254 of the gray level 254.

The compensation data signal A_q_Gp in FIGS. 6A to 6D means an analog voltage for the corresponding compensated image data signal. The image data signal and the compensated image data signal are digital signals, and the compensation data signal is an analog voltage corresponding to the compensated image data signal. In other words, the compensation data signal is an analog voltage predetermined in accordance with the digital compensated image data signal. For example, A_k−1_G255 in FIG. 6A means an analog voltage for the compensated image data signal D_k−1 G255.

In FIGS. 6A to 6D, the compensation data signal has a different gray value depending on the gray level. For example, the higher the gray level of the compensation data signal, the greater the gray value of the compensation data signal. For example, the compensation data signal A_k−1_G255 of the gray level 255 in FIG. 6A has a gray value greater than that of the compensation data signal A_k−1_G254 of the gray level 254.

Depending on the type of the driving switching element, the voltage (i.e., the analog voltage) of the compensation data signal may gradually increase or gradually decrease in proportion to the gray value of the compensation data signal. For example, as illustrated in FIG. 2, when the second switching element Tr2 of the pixel is a P-type transistor, the greater the gray value of the compensation data signal, the lower the voltage of the compensation data signal. For example, when the second switching element Tr2 of the pixel described above is a P-type transistor, the compensation data signal A_k−1_G255 of the gray level 255 in FIG. 6A may have a voltage lower than that of the compensation data signal A_k−1_G254 of the gray level 254. On the other hand, when the second switching element Tr2 of the pixel is an N-type transistor, the greater the gray value of the compensation data signal, the higher the voltage of the compensation data signal. For example, when the second switching element Tr2 of the pixel described above is an N-type transistor, the compensation data signal A_k−1_G255 of the gray level 255 in FIG. 6A may have a voltage higher than that of the compensation data signal A_k−1_G254 of the gray level 254.

The data signal A_Gp in FIG. 6E denotes an analog voltage for the corresponding image data signal. For example, A_G255 in FIG. 6E means an analog voltage for the image data signal D_G255.

In FIG. 6E, the data signals have a different gray value depending on the gray level. For example, the higher the gray level of the data signal, the greater the gray value of the data signal. For example, the data signal A_G255 of the gray level 255 in FIG. 6E has a gray value greater than that of the data signal A_G254 of the gray level 254.

Depending on the type of the driving switching element, the voltage (i.e., the analog voltage) of the data signal may gradually increase or gradually decrease in proportion to the gray value of the data signal. For example, as illustrated in FIG. 2, when the second switching element Tr2 of the pixel is a P-type transistor, the greater the gray value of the data signal, the lower the voltage of the data signal. For example, when the second switching element Tr2 of the pixel described above is a P-type transistor, the data signal A_G255 of the gray level 255 in FIG. 6E may have a voltage lower than that of the data signal A_G254 of the gray level 254. On the other hand, when the second switching element Tr2 of the pixel is an N-type transistor, the greater the gray value of the data signal, the higher the voltage of the data signal. For example, when the second switching element Tr2 of the pixel described above is an N-type transistor, the data signal A_G255 of the gray level 255 in FIG. 6E may have a voltage higher than that of the data signal A_G254 of the gray level 254.

The timing controller 122 compensates for the image data signal of the pixel PX provided from the system based on the number of LEDs included in the pixel PX.

For example, as the number of LEDs included in the pixel PX is smaller, the compensated image data signal of the pixel PX may have a less gray value.

For example, the timing controller 122 may compare a predetermined reference value "k" (see FIG. 6E) with the number of LEDs of the pixel PX, and compensate for the image data signal of the pixel PX based on the comparison result, where k is a natural number.

The reference value means the number of LEDs included in the pixel when light of a normal intended color is emitted from the pixel. For example, as illustrated in FIG. 7, in the case where green light is normally generated from five green LEDs included in a green pixel when the image data signal of the highest gray level (e.g., the gray level 255) is applied to the green pixel, the reference value may be 5. In such an example embodiment, the normal green light may have a color located in the coordinates of green light (i.e., X=0.149 and Y=0.657) in the CIE chromaticity coordinate system. On the other hand, as the number of LEDs of the green pixel is reduced from its reference value of 5, the light from the green pixel has a color closer to blue. For example, as illustrated in FIG. 7, when the number of LEDs of the green pixel is one, the light may have a color located in the coordinates of blue light (i.e., X=0.129 and Y=0.287) in the CIE chromaticity coordinate system.

The CIE chromaticity coordinate system in FIG. 7 includes a green area A1, a blue area A2, and a red area A3.

As a result of the above-described comparison, when it is determined that the number of LEDs of the pixel PX is less than the reference value "k", the timing controller 122 may correct (or modulate) the image data signal of the pixel PX into the compensated image data signal having a gray value less than that of the image data signal of the pixel PX.

For example, as illustrated in FIG. 6A, when the pixel PX includes "k−1" number of LEDs the number of which is less than the reference value "k" and the gray level of the image data signal D_G255 of the pixel PX is 255, the timing controller 122 may output D_k−1_G255 as the compensated image data signal of the pixel PX. The compensated image data signal D_k−1_G255 has a gray value less than that of the image data signal D_G255. In other words, the image data signal D_G255 and the compensated image data signal D_k−1_G255 have the same gray level 255, but the gray value of D_G255 and the gray value of D_k−1_G255 are different from each other.

As such, the compensated image data signal in FIG. 6A has a gray value less than that of the image data signal corresponding thereto. In other words, the compensated image data signal has a gray value less than that of the image data signal that has the same gray level as that of the compensated image data signal.

The compensated image data signals output from the timing controller 122 are applied to the data driver 153. For example, the above-described compensated image data signal D_k−1_G255 is applied to the data driver 153.

The data driver 153 outputs (e.g., selects and outputs) a compensation data signal corresponding to the compensated image data signal. For example, the data driver 153 outputs the compensation data signal A_k−1_G255 that corresponds to the compensated image data signal D_k−1_G255. As used herein, the compensation data signal A_k−1_G255 means an analog voltage corresponding to the compensated image data signal D_k−1_G255.

When the number of LEDs of the pixel PX is less than the reference value "k" as described above, as the difference between the number of LEDs of the pixel PX and the reference value "k" increases, the timing controller 122 outputs a compensated image data signal having a less gray value. Accordingly, the greater the difference between the number of LEDs of the pixel PX and the reference value, the greater the difference in gray value between the image data signal and its compensated image data signal.

For example, when a pixel including "k−1" number of LEDs illustrated in FIG. 6A is defined as a first pixel, and a pixel including "k−2" number of LEDs illustrated in FIG. 6B is defined as a second pixel, the compensated image data signal of the second pixel has a gray value less than that of the compensated image data signal of the first pixel although it has the same gray level as that of the compensated image data signal of the second pixel. For example, the compensated image data signal D_k−2_G255 of the gray level 255 in FIG. 6B has a gray value less than that of the compensated image data signal D_k−1_G255 of the gray level 255 in FIG. 6A.

Similarly, D_k−2_G0 has a gray value less than that of D_k−1_G0, D_k−2_G1 has a gray value less than that of D_k−1_G1, and D_k−2_G2 has a gray value less than that of D_k−1_G2, and D_k−2_G254 has a gray value less than that of D_k−1_G254.

Accordingly, A_k−2_G0 has a gray value less than that of A_k−1_G0, A_k−2_G1 has a gray value less than that of A_k−1_G1, A_k−2_G2 has a gray value less than that of A_k−1_G2, and A_k−2_G254 has a gray value less than that of A_k−1_G254.

When the number of LEDs of the pixel PX is less than the predetermined reference value "k", the pixel PX receives the data signal (i.e., the compensation data signal) that is set based on the image data signal (i.e., the compensated image data signal) having a gray value less than that of the original image data signal. Accordingly, the pixel PX may generate a driving current having a level less than that of the reference pixel. For example, the pixel circuit 180 of the pixel PX may generate a driving current having a level less than that of the pixel circuit 180 of the reference pixel. As used herein, the reference pixel means a pixel that includes LEDs the number of which corresponds to the reference value.

Accordingly, the LED of the pixel PX and the LED of the reference pixel may respectively receive unit driving currents of a substantially same level. In other words, when the driving current is divided to be applied to the plurality of LEDs that are included in one pixel, the divided current may be defined as a unit driving current, and the unit driving current applied to each LED of the pixel PX and the unit driving current applied to each LED of the reference pixel may be substantially equal to each other. Accordingly, although the pixel PX and the reference pixel include different numbers of LEDs, respectively, light (e.g., green light) of substantially the same color (e.g., the color of the same coordinates on the chromaticity coordinate system) may be generated.

On the other hand, if the comparison result indicates that the number of LEDs of the pixel PX is greater than the reference value "k", the timing controller 122 may correct (or modulate) the image data signal of the pixel PX into the compensated image data signal having a gray value greater than that of the image data signal of the pixel PX.

For example, as illustrated in FIG. 6C, when the pixel PX includes "k+1" number of LEDs the number of which is greater than the reference value "k" and the gray level of the image data signal D_G255 of the pixel PX is 255, the timing controller 122 may output D_k+1_G255 as the compensated image data signal of the pixel PX. The compensated image data signal D_k+1_G255 has a gray value greater than that of the image data signal D_G255. In other words, the image data signal D_G255 and the compensated image data signal D_k+1_G255 have the same gray level 255, but the gray value of D_G255 and the gray value of D_k+1_G255 are different from each other.

As such, the compensated image data signal in FIG. 6C has a gray value greater than that of the image data signal corresponding thereto. In other words, the compensated image data signal has a gray value greater than that of the image data signal that has the same gray level as that of the compensated image data signal.

The compensated image data signal D_k+1_G255 output from the timing controller 122 is applied to the data driver 153. The data driver 153 outputs a compensation data signal A_k+1_G255 corresponding to the compensated image data signal D_k+1_G255. As used herein, the compensation data signal A_k+1_G255 means an analog voltage corresponding to the compensated image data signal D_k+1 G255.

In addition, as described above, when the number of LEDs of the pixel PX is greater than the reference value "k" as described above, as the difference between the number of LEDs of the pixel PX and the reference value "k" increases, the timing controller 122 outputs a compensated image data signal having a greater gray value. Accordingly, the greater the difference between the number of LEDs of the pixel PX and the reference value, the greater the difference in gray value between the image data signal and its compensated image data signal.

For example, when a pixel including "k+1" number of LEDs illustrated in FIG. 6C is defined as a first pixel, and a pixel including "k+2" number of LEDs illustrated in FIG. 6D is defined as a second pixel, the compensated image data signal of the second pixel has a gray value greater than that of the compensated image data signal of the first pixel that has the same gray value as that of the compensated image data signal of the second pixel. For example, the compensated image data signal D_k+2_G255 of the gray level 255 in FIG. 6D has a gray value greater than that of the compensated image data signal D_k+1_G255 of the gray level 255 in FIG. 6C.

Similarly, D_k+2_G0 has a gray value greater than that of D_k+1_G0, D_k+2_G1 has a gray value greater than that of D_k+1_G1, and D_k+2_G2 has a gray value greater than that of D_k+1_G2, and D_k+2_G254 has a gray value greater than that of D_k+1 G254.

Accordingly, A_k+2_G0 has a gray value greater than that of A_k+1_G0, A_k+2_G1 has a gray value greater than that of A_k+1_G1, A_k+2_G2 has a gray value greater than that of A_k+1_G2, and A_k+2_G254 has a gray value greater than that of A_k+1_G254.

In some example embodiments, in FIGS. 6A to 6E, the compensation data signal of the lowest gray level (or the data signal of the lowest gray level) may all have the same gray value. For example, A_k−1_G0, A_k−2_G0, A_k+1_G0, A_k+2_G0 and A_G0 may have the same gray value.

As such, when the number of LEDs of the pixel PX is greater than the predetermined reference value "k", the pixel PX receives the data signal (i.e., the compensation data signal) that is set based on the image data signal (i.e., the compensated image data signal) having a gray value greater than that of the original image data signal. Accordingly, the pixel PX may generate a driving current having a level greater than that of the reference pixel. For example, the pixel circuit 180 of the pixel PX may generate a driving current having a level greater than that of the pixel circuit 180 of the reference pixel.

Accordingly, the LED of the pixel PX and the LED of the reference pixel may respectively receive unit driving currents of a substantially same level. In other words, the unit driving current applied to each LED of the pixel PX and the unit driving current applied to each LED of the reference pixel may be substantially equal to each other. Accordingly, although the pixel PX and the reference pixel include different numbers of LEDs, respectively, light (e.g., green light) of substantially the same color (e.g., the color of the same coordinates on the chromaticity coordinate system) may be generated.

On the other hand, when the number of LEDs of the pixel PX is equal to the reference value "k", the timing controller 122 may output the image data signal of the pixel substantially without correction.

For example, as illustrated in FIG. 6E, when the pixel PX includes the same number of LEDs as the reference value "k" and the gray level of the image data signal D_G255 of the pixel PX is the gray level 255, for example, the timing controller 122 outputs the image data signal D_G255 as it is without correction.

The image data signal D_G255 output from the timing controller 122 is applied to the data driver 153. The data driver 153 outputs a data signal A_G255 corresponding to the image data signal D_G255. As used herein, the data signal A_G255 means an analog voltage corresponding to the image data signal D_G255.

A_G0 has a gray value less than that of A_k+1_G0 and greater than that of A_k−1_G0, A_G1 has a gray value less than that of A_k+1_G1 and greater than that of A_k−1_G1, A_G254 has a gray value less than that of A_k+1_G254 and greater than that of A_k−1_G254, and A_G255 has a gray value less than that of A_k+1_G255 and greater than that of A_k−1_G255.

Figure 8:
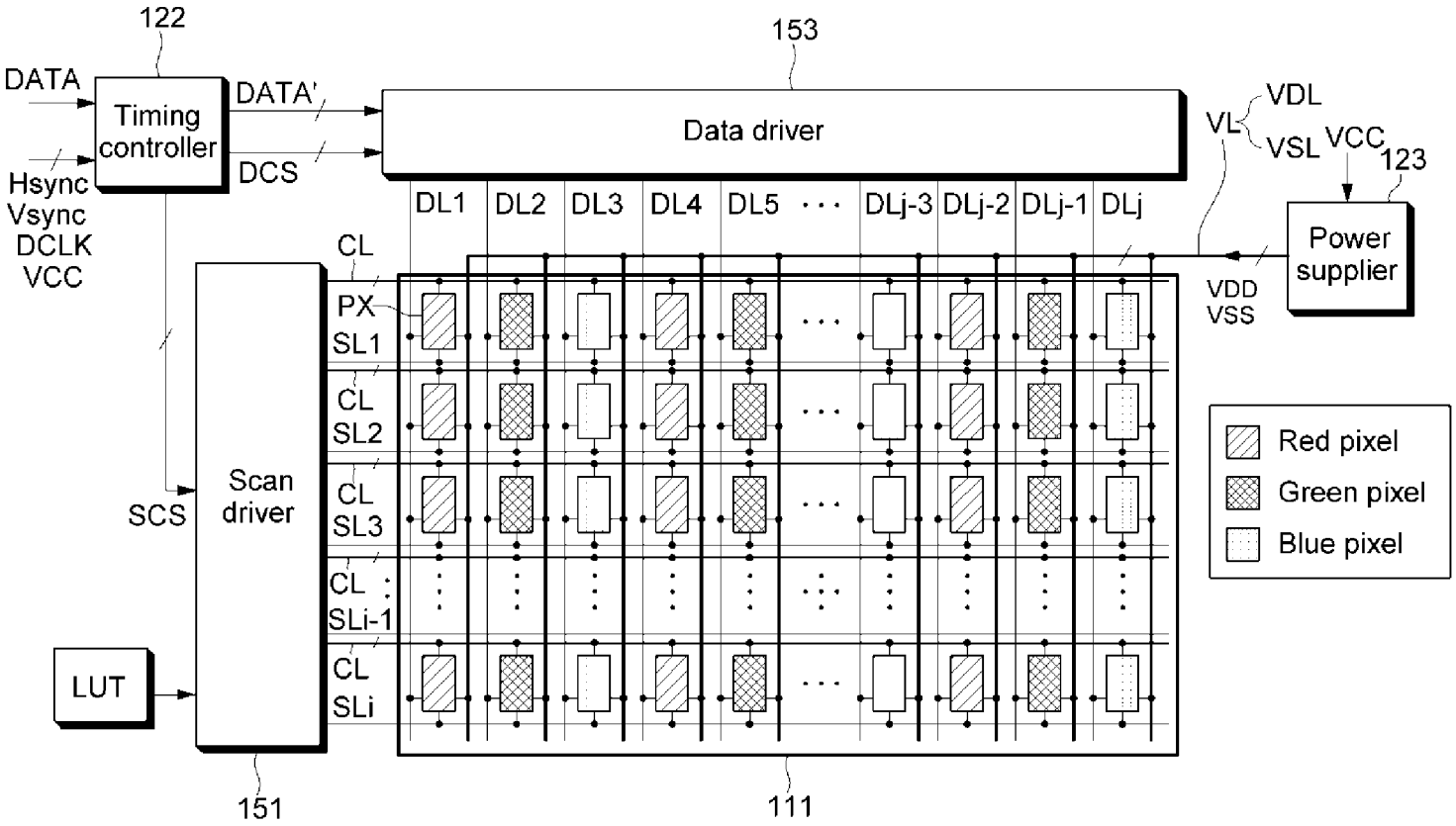
FIG. 8 is a view illustrating a display device according to some example embodiments of the present invention.

FIG. 8 is a view illustrating a display device according to some example embodiments of the present invention.

A display device according to another embodiment of the present invention includes a display panel 111, a scan driver 151, a data driver 153, a timing controller 122, a look-up table LUT, and a power supplier 123, as illustrated in FIG. 8.

The display panel 111 in FIG. 8 includes a plurality of pixels PX, a plurality of scan lines SL1 to SLi, a plurality of data lines DL1 to DLj, a first driving power line VDL, a second driving power line VSL, and a plurality of compensation lines CL.

The plurality of pixels PX, the plurality of scan lines SL1 to SLi, the plurality of data lines DL1 to DLj, the first driving power line VDL, and the second driving power line VSL in FIG. 8 are substantially the same as the plurality of pixels PX, the plurality of scan lines SL1 to SLi, the plurality of data lines DL1 to DLj, the first driving power line VDL, and the second driving power line VSL in FIG. 2, respectively.

The plurality of compensation lines CL are connected to a scan driver 151. In addition, the plurality of compensation lines CL are connected to the plurality of pixels PX, respectively. For example, "i*j" number of compensation lines CL are individually connected to the "i*j" number of pixels PX, respectively. In other words, "i*j" number of pixels PX are individually connected to compensation lines CL different from each other.

The timing controller 122 in FIG. 8 rearranges the image data signals DATA applied from the system and applies the rearranged image data signals DATA' to a data driver 153.

The timing controller 122 generates a data control signal DCS and a scan control signal SCS based on a horizontal synchronization signal Hsync, a vertical synchronization signal Vsync, and a clock signal DCLK input to the timing controller 122 and outputs the data control signal DCS and the scan control signal SCS to the data driver 153 and the scan driver 151, respectively. The data control signal DCS is applied to the data driver 153 and the scan control signal SCS is applied to the scan driver 151.

The data control signal DCS includes a dot clock, a source shift clock, a source enable signal and a polarity inversion signal.

The scan control signal SCS includes a gate start pulse, a gate shift clock and a gate output enable signal.

The data driver 153 in FIG. 8 samples the rearranged image data signals DATA' according to the data control signal DCS from the timing controller 122, latches the sampled image data signals corresponding to one horizontal line in each horizontal time (1H, 2H, . . . ), and applies the latched image data signals to the data lines DL1 to DLj. For example, the data driver 153 converts the rearranged image data signal DATA' applied from the timing controller 122 into an analog signal using a gamma voltage input from the power supplier 123, and applies the analog signals to the data lines DL1 to DLj.

The scan driver 151 in FIG. 8 includes a shift register that generates scan signals in response to the gate start pulse in the scan control signal SCS applied from the timing controller 122 and a level shifter that shifts the scan signals to a voltage level suitable for driving the pixel PX. The scan driver 151 applies first to i-th scan signals to the scan lines SL1 to SLi, respectively, in response to the scan control signal SCS applied from the timing controller 122.

In addition, the scan driver 151 in FIG. 8 generates a compensation voltage for each pixel PX based on the number of LEDs of each pixel PX provided from the look-up table LUT and applies the compensation voltage to the compensation line CL.

The compensation voltage is a DC voltage and may have a different value depending on the number of LEDs included in the pixel PX. For example, the less the number of LEDs included in the pixel PX, the lower the compensation voltage applied to the pixel PX.

The power supplier 123 in FIG. 8 is the same as (or substantially the same as) the power supplier 123 in FIG. 1 described above.

Figure 9:
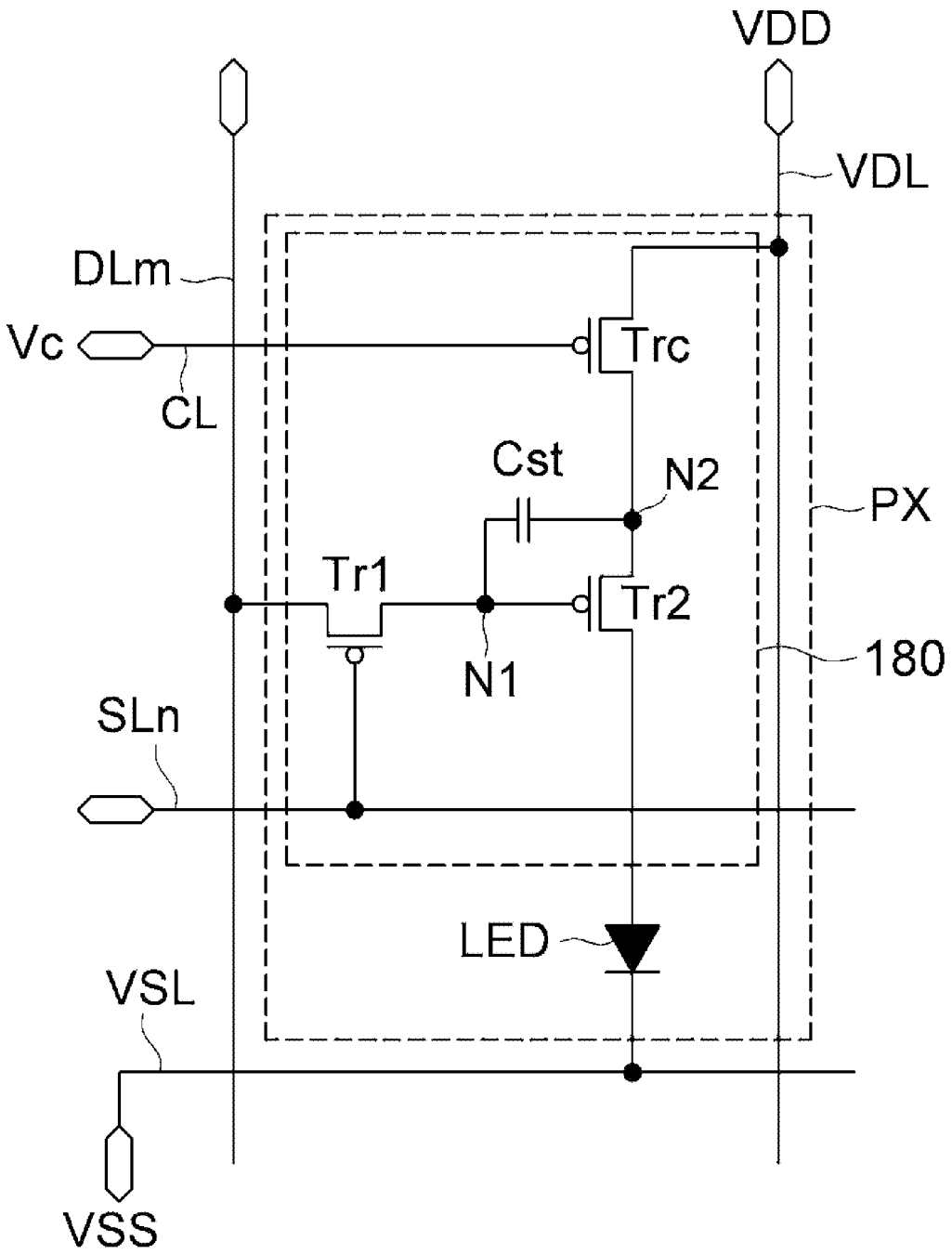
FIG. 9 is a circuit diagram illustrating one pixel in FIG. 8 according to some example embodiments of the present invention.

FIG. 9 is a circuit diagram illustrating one pixel in FIG. 8 according to an embodiment of the present invention.

A pixel PX includes a pixel circuit 180 and an LED receiving a driving current from the pixel circuit 180, as illustrated in FIG. 9.

The pixel circuit 180 may include a first switching element Tr1, a second switching element Tr2, a compensation switching element Trc and a storage capacitor Cst.

The first switching element Tr1 in FIG. 9 is substantially the same as the first switching element Tr1 in FIG. 2 described above.

The LED in FIG. 9 is substantially the same as the LED in FIG. 2 described above.

The second switching element Tr2 includes a second gate electrode connected to a first node N1, and is connected between a second node N2 and a first electrode of the LED. One of a second drain electrode and a second source electrode of the second switching element Tr2 is connected to the second node N2, and the other of the second drain electrode and the second source electrode of the second switching element Tr2 is connected to the first electrode of the LED. For example, the second source electrode of the second switching element Tr2 is connected to the second node N2, and the second drain electrode of the second switching element Tr2 is connected to the first electrode of the LED.

The second switching element Tr2 adjusts an amount (density) of a driving current applied from a first driving power line VDL to a second driving power line VSL through the compensation switching element Trc according to the magnitude of the signal applied to the second gate electrode of the second switching element Tr2.

The compensation switching element Trc in FIG. 9 includes a gate electrode connected to the compensation line CL, and is connected between the first driving power line VDL and the second node N2. One of a source electrode and a drain electrode of the compensation switching element Trc is connected to the first driving power line VDL, and the other of the source electrode and the drain electrode of the compensation switching element Trc is connected to the second node N2. For example, the source electrode of the compensation switching element Trc is connected to the first driving power line VDL, and the drain electrode of the compensation switching element Trc is connected to the second node N2.

The compensation switching element Trc adjusts an amount (density) of a driving current applied from the first driving power line VDL to the second switching element Tr2 according to the magnitude of a compensation voltage Vc applied to the gate electrode of the compensation switching element Trc.

The storage capacitor Cst is connected between the first node N1 and the second node N2. The storage capacitor Cst stores the signal applied to the second gate electrode of the second switching element Tr2 for one frame period.

The first electrode of the LED is connected to the second drain electrode of the second switching element Tr2, and a second electrode of the LED is connected to the second driving power line VSL. The LED emits light in accordance with the driving current applied through the compensation switching element Trc and the second switching element Tr2. The LED emits light of different brightness depending on the magnitude of the driving current.

The above-described compensation voltage Vc is applied to the gate electrode of the compensation switching element Trc.

The compensation voltage Vc may have a positive magnitude or a negative magnitude according to the type of the compensation switching element Trc. For example, as illustrated in FIG. 9, when the compensation switching element Trc is a p-type transistor, the compensation voltage Vc has a negative magnitude. On the other hand, when the compensation switching element Trc is an N-type transistor, the compensation voltage Vc has a positive magnitude. Accordingly, unless otherwise stated, the magnitude of the compensation voltage Vc means the magnitude of the absolute value of the compensation voltage Vc. That is, the less the number of LEDs included in the pixel PX, the less the absolute value of the compensation voltage Vc applied to the pixel PX.

For example, in the case where the first, second, and third pixels PX1, PX2, and PX3 all include LEDs of the same color (e.g., green LEDs), as illustrated in FIG. 3, when the second pixel PX2 includes fewer LEDs than the first pixel PX1, the compensation voltage Vc applied to the second pixel PX2 is lower than the compensation voltage Vc applied to the first pixel PX1. That is, the compensation voltage Vc applied to the gate electrode of the compensation switching element Trc included in the second pixel PX2 is lower than the compensation voltage Vc applied to the gate electrode of the compensation switching element Trc included in the first pixel PX1.

Accordingly, the compensation switching element Trc of the second pixel PX2 is turned on with a level less than that of the compensation switching element Trc of the first pixel PX1. In other words, the compensation switching element Trc of the second pixel PX2 has a resistance (e.g., internal resistance of the transistor) greater than that of the compensation switching element Trc of the first pixel PX1. Accordingly, the driving current applied to the LED of the second pixel PX2 through the compensation switching element Trc of the second pixel PX2 is less than the driving current applied to the LED of the first pixel PX1 through the compensation switching element Trc of the first pixel PX1.

As described above, the pixel circuit 180 of the second pixel PX2 including a relatively less number of LEDs generates a driving current of a level less than that of the pixel circuit 180 of the first pixel PX1 including a relatively greater number of LEDs. Accordingly, the LED of the second pixel PX2 and the LED of the first pixel PX1 may respectively receive unit driving currents of a substantially same level. In other words, the unit driving current applied to each LED of the first pixel PX1 and the unit driving current applied to each LED of the second pixel PX2 may be substantially equal to each other. Accordingly, although the first pixel PX1 and the second pixel PX2 include different numbers of LEDs, respectively, light (e.g., green light) of substantially the same color (e.g., the color of the same coordinates on the chromaticity coordinate system) may be generated.

In addition, because the third pixel PX3 includes fewer LEDs than the second pixel PX2, the third pixel PX3 may be as illustrated in FIG. 3, the compensation voltage Vc applied to the compensation switching element Trc of the third pixel PX3 is lower than the compensation voltage Vc applied to the compensation switching element Trc of the second pixel PX2. Accordingly, although the first, second, and third pixels PX1, PX2, and PX3 include different numbers of LEDs, they may generate light of substantially the same color.

When a pixel that includes LEDs the number of which corresponds to the reference value "k" described above is defined as a reference pixel, and a compensation voltage Vc applied to the compensation switching element Trc of the reference pixel is defined as a reference compensation voltage, the scan driver 151 may apply the compensation voltage Vc that has a value less than that of the reference compensation voltage to a pixel including a smaller number of LEDs than the reference value "k". In such a case, when the number of LEDs of the pixel PX is less than the reference value "k", as the difference between the number of LEDs of the pixel PX and the reference value "k" increases, the scan driver 151 applies a lower compensation voltage Vc to the pixel PX.

On the other hand, the scan driver 151 may apply the compensation voltage Vc that has a value greater than that of the reference compensation voltage to a pixel including a greater number of LEDs than the reference value "k". In such a case, when the number of LEDs of the pixel PX is greater than the reference value "k", as the difference between the number of LEDs of the pixel PX and the reference value "k" increases, the scan driver 151 applies a higher compensation voltage Vc to the pixel PX.

Figure 10:
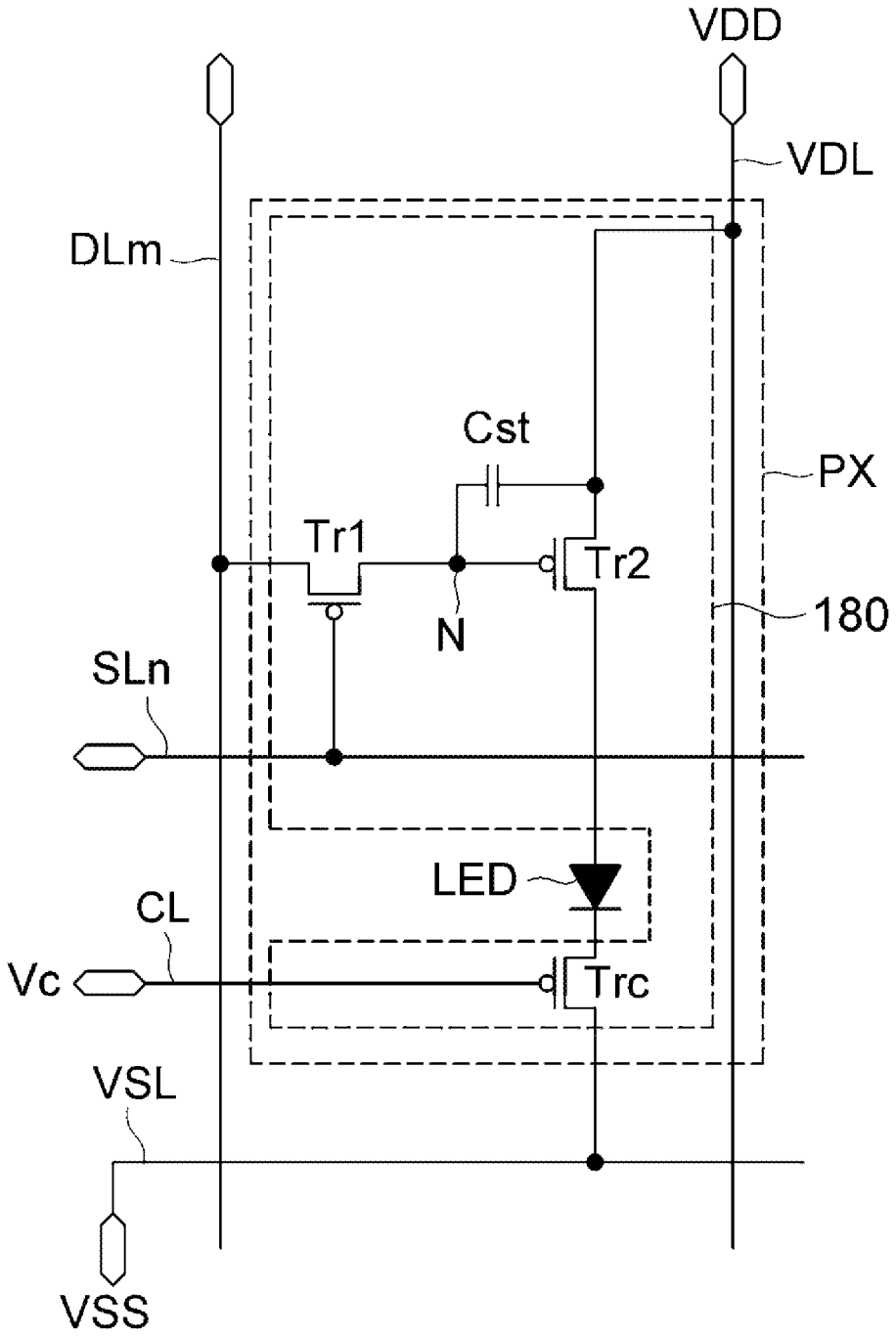
FIG. 10 is a circuit diagram illustrating one pixel in FIG. 8 according to some example embodiments of the present invention.

FIG. 10 is a circuit diagram illustrating one pixel in FIG. 8 according to some example embodiments of the present invention.

A pixel PX includes a pixel circuit 180 and an LED receiving a driving current from the pixel circuit 180, as illustrated in FIG. 10.

The pixel circuit 180 may include a first switching element Tr1, a second switching element Tr2, a compensation switching element Trc and a storage capacitor Cst.

The first switching element Tr1 in FIG. 10 is the same as (or substantially the same as) the first switching element Tr1 in FIG. 2 described above.

The second switching element Tr2 in FIG. 10 is the same as (or substantially the same as) the second switching element Tr2 in FIG. 2 described above.

The storage capacitor Cst in FIG. 10 is the same as (or substantially the same as) the storage capacitor Cst in FIG. 2 described above.

The compensation switching element Trc in FIG. 10 includes a third gate electrode connected to a compensation line CL and is connected between a second electrode of the LED and a second driving power line VSL. One of a source electrode and a drain electrode of the compensation switching element Trc is connected to the second electrode of the LED, and the other of the source electrode and the drain electrode of the compensation switching element Trc is connected to the second driving power line VSL. For example, the source electrode of the compensation switching element Trc is connected to the second electrode of the LED, and the drain electrode of the compensation switching element Trc is connected to the second driving power line VSL.

The compensation switching element Trc adjusts an amount (density) of a driving current applied from the LED to the second driving power line VSL according to the magnitude of compensation voltage Vc applied to the gate electrode of the compensation switching element Trc.

In FIG. 10, a first electrode of the LED is connected to a second drain electrode of the second switching element Tr2, and the second electrode of the LED is connected to the source electrode of the compensation switching element Trc.

The LED emits light in accordance with the driving current applied through the compensation switching element Trc and the second switching element Tr2. The LED emits light of different brightness depending on the magnitude of the driving current.

The above-described compensation voltage Vc is applied to the gate electrode of the compensation switching element Trc.

The compensation voltage Vc may have a positive magnitude or a negative magnitude according to the type of the compensation switching element Trc. For example, as illustrated in FIG. 10, when the compensation switching element Trc is a p-type transistor, the compensation voltage Vc has a negative magnitude. On the other hand, when the compensation switching element Trc is an N-type transistor, the compensation voltage Vc has a positive magnitude. Accordingly, unless otherwise stated, the magnitude of the compensation voltage Vc means the magnitude of the absolute value of the compensation voltage Vc. That is, the less the number of LEDs included in the pixel PX, the less the absolute value of the compensation voltage Vc applied to the pixel PX.

For example, in the case where the first, second, and third pixels PX1, PX2, and PX3 all include LEDs of the same color (e.g., green LEDs), as illustrated in FIG. 3, when the second pixel PX2 includes fewer LEDs than the first pixel PX1, the compensation voltage Vc applied to the second pixel PX2 is lower than the compensation voltage Vc applied to the first pixel PX1. That is, the compensation voltage Vc applied to the gate electrode of the compensation switching element Trc included in the second pixel PX2 is lower than the compensation voltage Vc applied to the gate electrode of the compensation switching element Trc included in the first pixel PX1.

Accordingly, the compensation switching element Trc of the second pixel PX2 is turned on with a level less than that of the compensation switching element Trc of the first pixel PX1. Accordingly, as described hereinabove with reference to FIG. 9, pixels including different numbers of LEDs may generate light of the same (or substantially the same) color.

Figure 11:
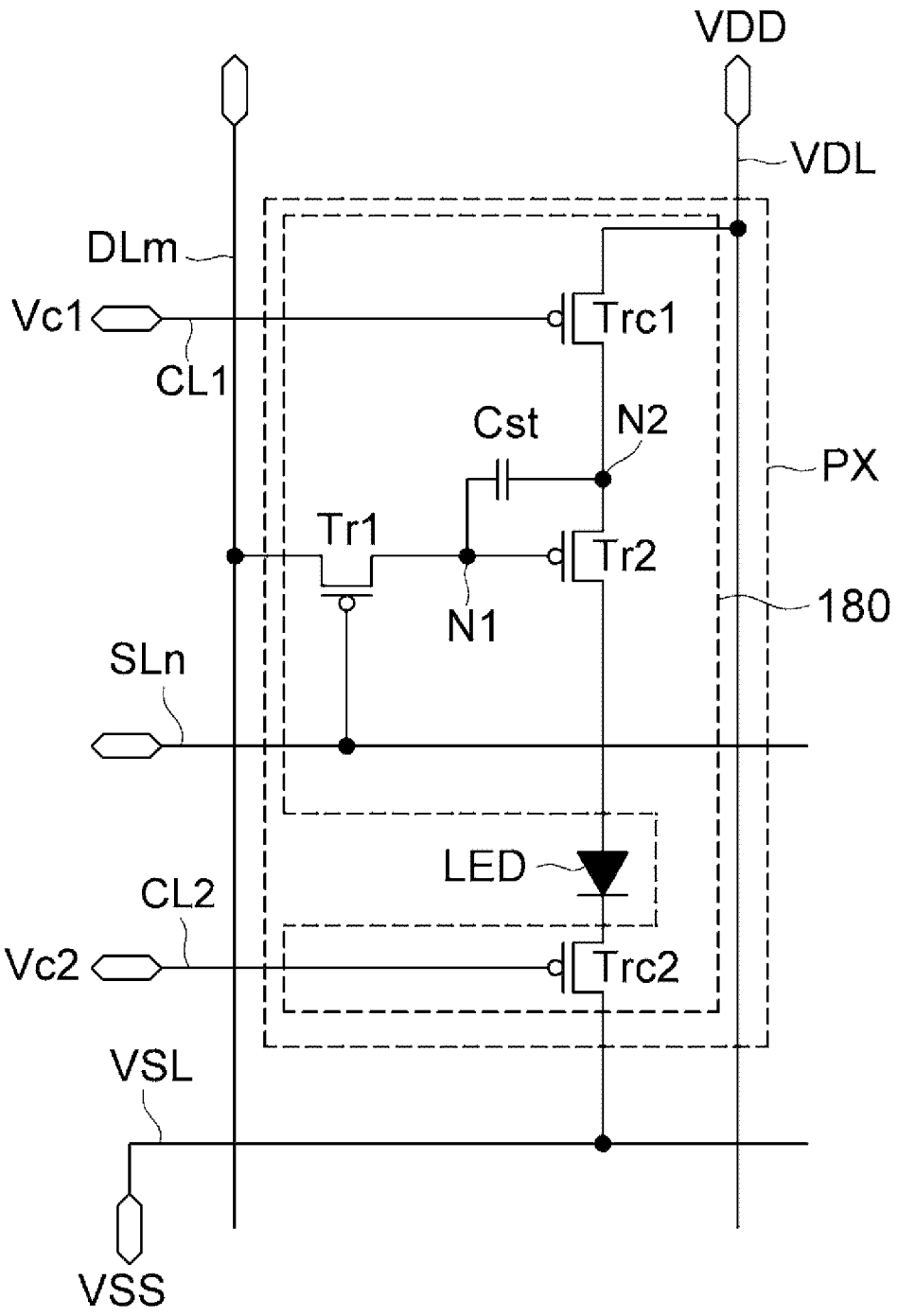
FIG. 11 is a circuit diagram illustrating one pixel in FIG. 8 according to some example embodiments of the present invention.

FIG. 11 is a circuit diagram illustrating one pixel of FIG. 8 according to another embodiment of the present invention.

A pixel PX includes a pixel circuit 180 and an LED receiving a driving current from the pixel circuit 180, as illustrated in FIG. 11.

The pixel circuit 180 may include a first switching element Tr1, a second switching element Tr2, a first compensation switching element Trc1, a second compensation switching element Trc2, and a storage capacitor Cst.

The first switching element Tr1 in FIG. 11 is the same as (or substantially the same as) the first switching element Tr1 in FIG. 2 described above.

The second switching element Tr2 in FIG. 11 is the same as (or substantially the same as) the second switching element Tr2 in FIG. 9 described above.

The first compensation switching element Trc1 in FIG. 11 is the same as (or substantially the same as) the compensation switching element Trc in FIG. 9 described above.

The second compensation switching element Trc2 in FIG. 11 is the same as (or substantially the same as) the compensation switching element Trc in FIG. 10 described above.

The LED in FIG. 11 is the same as (or substantially the same as) the LED in FIG. 10 described above.

A first compensation line CL1 connected to the first compensation switching element Trc1 is the same as (or substantially the same as) the compensation line CL in FIG. 9.

A second compensation line CL2 connected to the second compensation switching element Trc2 is the same as (or substantially the same as) the compensation line CL in FIG. 10.

The first compensation switching element Trc1 and the second compensation switching element Trc2 of each pixel are connected to a scan driver 151. For example, a gate electrode of the first compensation switching element Trc1 included in each pixel PX and a gate electrode of the second compensation switching element Trc2 included in each pixel PX are connected to the scan driver 151 individually.

The LED emits light in accordance with the driving current controlled by the first compensation switching element Trc1, the second switching element Tr2 and the second compensation switching element Trc2. The LED emits light of different brightness depending on the magnitude of the driving current.

A first compensation voltage Vc1 may have a positive magnitude or a negative magnitude according to the type of the first compensation switching element Trc1. For example, as illustrated in FIG. 11, when the first compensation switching element Trc1 is a p-type transistor, the first compensation voltage Vc1 has a negative magnitude. On the other hand, when the first compensation switching element Trc1 is an N-type transistor, the first compensation voltage Vc1 has a positive magnitude. Accordingly, unless otherwise stated, the magnitude of the first compensation voltage Vc1 means the magnitude of the absolute value of the first compensation voltage Vc1. That is, the less the number of LEDs included in the pixel PX, the less the absolute value of the first compensation voltage Vc1 applied to the pixel PX.

For example, in the case where first, second, and third pixels PX1, PX2, and PX3 all include LEDs of the same color (e.g., green LEDs), as illustrated in FIG. 3, when the second pixel PX2 includes fewer LEDs than the first pixel PX1, the first compensation voltage Vc1 applied to the second pixel PX2 is lower than the first compensation voltage Vc1 applied to the first pixel PX1. That is, the first compensation voltage Vc1 applied to the gate electrode of the first compensation switching element Trc1 included in the second pixel PX2 is lower than the first compensation voltage Vc1 applied to the gate electrode of the first compensation switching element Trc1 included in the first pixel PX1.

A second compensation voltage Vc2 may have a positive magnitude or a negative magnitude according to the type of the second compensation switching element Trc2. For example, as illustrated in FIG. 11, when the second compensation switching element Trc2 is a p-type transistor, the second compensation voltage Vc2 has a negative magnitude. On the other hand, when the second compensation switching element Trc2 is an N-type transistor, the second compensation voltage Vc2 has a positive magnitude. Accordingly, unless otherwise stated, the magnitude of the second compensation voltage Vc2 means the magnitude of the absolute value of the second compensation voltage Vc2. That is, the less the number of LEDs included in the pixel PX, the less the absolute value of the second compensation voltage Vc2 applied to the pixel PX.

For example, in the case where first, second, and third pixels PX1, PX2, and PX3 all include LEDs of the same color (e.g., green LEDs), as illustrated in FIG. 3, when the second pixel PX2 includes fewer LEDs than the first pixel PX1, the second compensation voltage Vc2 applied to the second pixel PX2 is lower than the second compensation voltage Vc2 applied to the first pixel PX1. That is, the second compensation voltage Vc2 applied to the gate electrode of the second compensation switching element Trc2 included in the second pixel PX2 is lower than the second compensation voltage Vc2 applied to the gate electrode of the second compensation switching element Trc2 included in the first pixel PX1.

Figure 12:
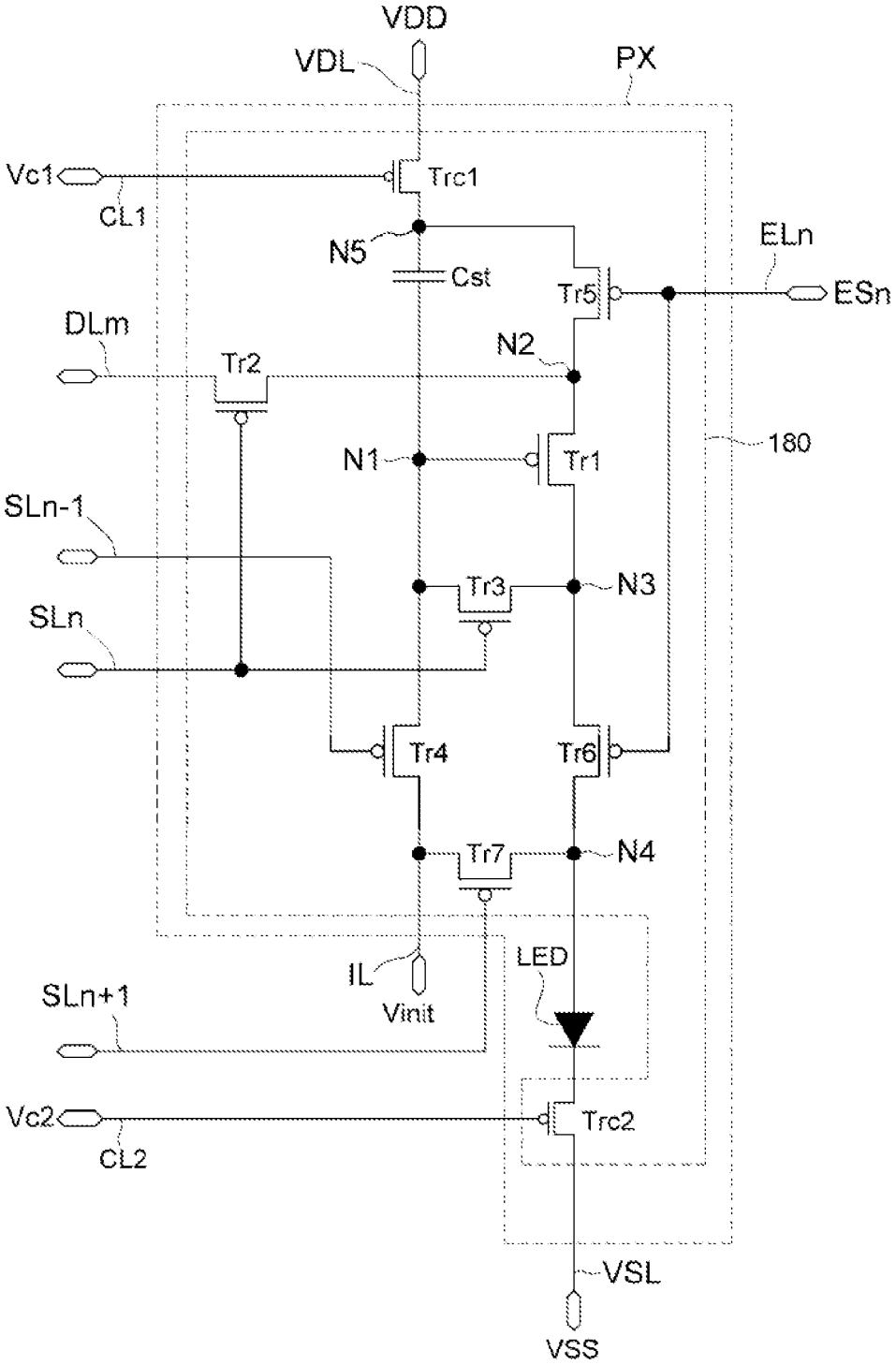
FIG. 12 is a circuit diagram illustrating one pixel in FIG. 8 according to some example embodiments of the present invention.

FIG. 12 is a circuit diagram illustrating one pixel in FIG. 8 according to some example embodiments of the present invention.

A pixel PX includes a pixel circuit 180 and an LED receiving a driving current from the pixel circuit 180, as illustrated in FIG. 12.

The pixel circuit 180 includes a first switching element Tr1, a second switching element Tr2, a third switching element Tr3, a fourth switching element Tr4, a fifth switching element Tr5, a sixth switching element Tr6, a seventh switching element Tr7, and a storage capacitor Cst.

The first switching element Tr1 in FIG. 12 includes a gate electrode connected to a first node N1, and is connected between a second node N2 and a third node N3. The first switching element Tr1 is a driving switching element for driving the LED, and the first switching element Tr1 adjusts an amount (density) of a driving current applied from a first driving power line VDL to a second driving power line VSL according to the magnitude of a data signal applied to the gate electrode of the first switching element Tr1.

The second switching element Tr2 in FIG. 12 includes a gate electrode connected to an n-th scan line SLn, and is connected between an m-th data line DLm and the second node N2.

The third switching element Tr3 in FIG. 12 includes a gate electrode connected to the n-th scan line SLn, and is connected between the first node N1 and the third node N3.

The fourth switching element Tr4 in FIG. 12 includes a gate electrode connected to an (n−1)-th scan line SLn−1 and is connected between the first node N1 and an initialization line IL. An initialization voltage Vinit is applied to this initialization line IL.

The fifth switching element Tr5 in FIG. 12 includes a gate electrode connected to an n-th emission control line ELn, and is connected between a fifth node N5 and the second node N2.

The sixth switching element Tr6 in FIG. 12 includes a gate electrode connected to the n-th emission control line ELn, and is connected between the third node N3 and a fourth node N4. An n-th emission control signal ESn is applied to the n-th emission control line ELn.

The seventh switching element Tr7 in FIG. 12 includes a gate electrode connected to an (n+1)-th scan line SLn+1 and is connected between the initialization line IL and the fourth node N4.

The first compensation switching element Trc1 in FIG. 12 includes a gate electrode connected to a first compensation line CL1, and is connected between the first driving power line VDL and the fifth node N5.

The second compensation switching element Trc2 in FIG. 12 includes a gate electrode connected to a second compensation line CL2, and is connected between a second electrode of the LED and the second driving power line VSL.

The storage capacitor Cst in FIG. 12 is connected between the first driving power line VDL and the first node N1. The storage capacitor Cst stores the signal applied to the gate electrode of the first switching element Tr1 for one frame period.

The LED in FIG. 12 is connected between the fourth node N4 and the second compensation switching element Trc2. For example, a first electrode of the LED is connected to the fourth node N4, and the second electrode of the LED is connected to the source electrode of the second compensation switching element Trc2.

The first compensation switching element Trc1 and the second compensation switching element Trc2 in FIG. 12 are the same as (or substantially the same as) the first compensation switching element Trc1 and the second compensation switching element Trc2 in FIG. 11, respectively.

In some example embodiments, the structure in which the first compensation switching element Trc1 and the second compensation switching element Trc2 are omitted from FIG. 12 may be applied to the pixel in FIG. 1 described above.

Figure 13:
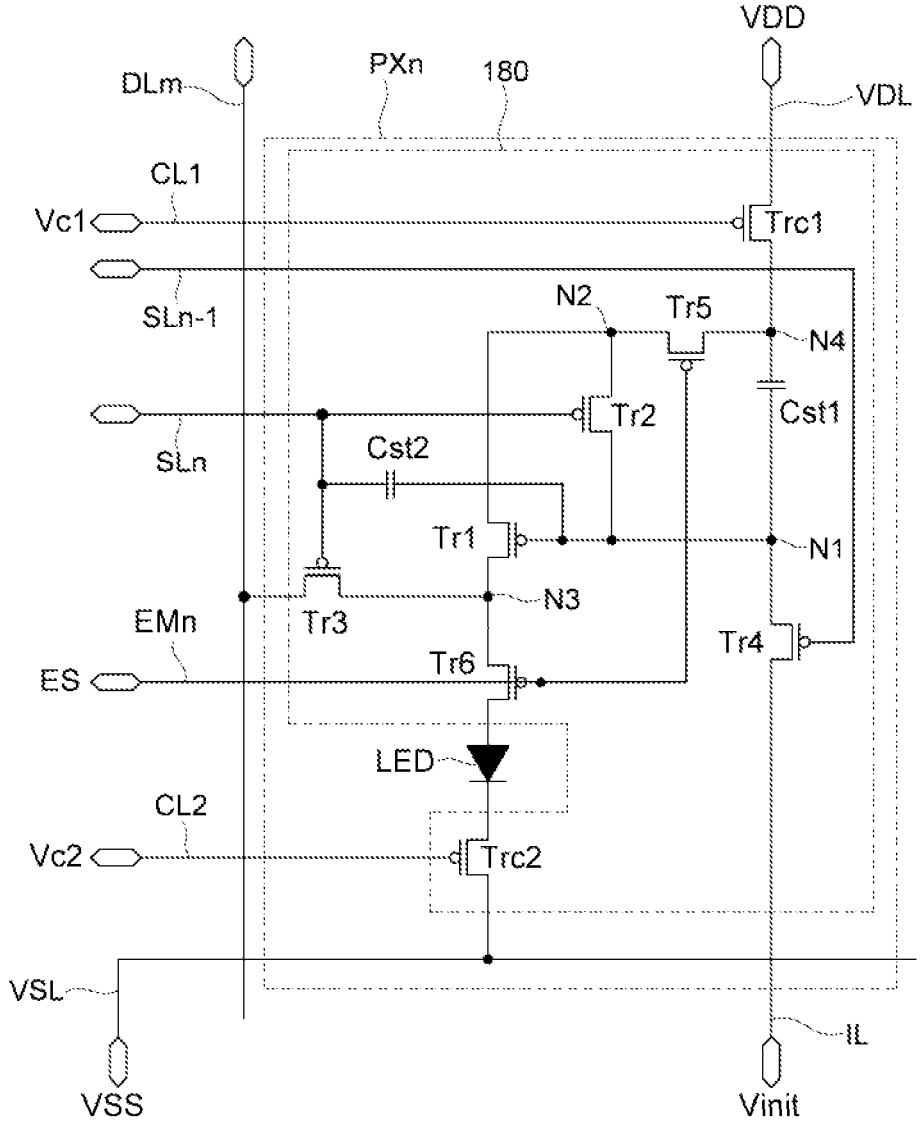
FIG. 13 is a circuit diagram illustrating one pixel in FIG. 8 according to some example embodiments of the present invention.

FIG. 13 is a circuit diagram illustrating one pixel in FIG. 8 according to some example embodiments of the present invention.

A pixel PX includes a pixel circuit 180 and an LED receiving a driving current from the pixel circuit 180, as illustrated in FIG. 13.

The pixel circuit 180 includes a first switching element Tr1, a second switching element Tr2, a third switching element Tr3, a fourth switching element Tr4, a fifth switching element Tr5, a sixth switching element Tr6, a first compensation switching element Trc1, a second compensation switching element Trc2, a first storage capacitor Cst1 and a second storage capacitor Cst2.

The first switching element Tr1 in FIG. 13 includes a gate electrode connected to a first node N1, and is connected between a second node N2 and a third node N3. The first switching element Tr1 is a driving switching element for driving the LED, and the first switching element Tr1 adjusts an amount (density) of a driving current applied from a first driving power line VDL to a second driving power line VSL according to the magnitude of a data signal applied to the gate electrode of the first switching element Tr1.

The second switching element Tr2 in FIG. 13 includes a gate electrode connected to an n-th scan line SLn, and is connected between the second node N2 and the first node N1.

The third switching element Tr3 in FIG. 13 includes a gate electrode connected to the n-th scan line SLn, and is connected between an m-th data line DLm and the third node N3.

The fourth switching element Tr4 in FIG. 13 includes a gate electrode connected to an (n−1)-th scan line SLn−1 and is connected between the first node N1 and an initialization line IL. An initialization voltage Vinit is applied to this initialization line IL.

The fifth switching element Tr5 in FIG. 13 includes a gate electrode connected to an n-th emission control line ELn, and is connected between the second node N2 and a fourth node N4. An n-th emission control signal ESn is applied to the n-th emission control line ELn.

The sixth switching element Tr6 in FIG. 13 includes a gate electrode connected to the n-th emission control line ELn, and is connected between the third node N3 and the first electrode of the LED.

The first compensation switching element Trc1 in FIG. 13 includes a gate electrode connected to a first compensation line CL1, and is connected between the first driving power line VDL and the fourth node N4.

The second compensation switching element Trc2 in FIG. 13 includes a gate electrode connected to a second compensation line CL2, and is connected between a second electrode of the LED and the second driving power line VSL.

The first storage capacitor Cst1 in FIG. 13 is connected between the fourth node N4 and the first node N1.

The second storage capacitor Cst2 in FIG. 13 is connected between the n-th scan line SLn and the first node N1.

The LED in FIG. 13 is connected between the drain electrode of the sixth switching element Tr6 and the source electrode of the second compensation switching element Trc2. That is, the first electrode of the LED is connected to the drain electrode of the sixth switching element Tr6, and the second electrode of the LED is connected to the source electrode of the second compensation switching element Trc2.

The first compensation switching element Trc1 and the second compensation switching element Trc2 in FIG. 13 are the same as (or substantially the same as) the first compensation switching element Trc1 and the second compensation switching element Trc2 in FIG. 11, respectively.

In some example embodiments, the structure in which the first compensation switching element Trc1 and the second compensation switching element Trc2 are omitted from FIG. 13 may be applied to the pixel in FIG. 1 described above.

In some example embodiments, the compensation voltages Vc, Vc1, and Vc2 described above may be applied from one of a data driver 153, a power supplier 123, and the timing controller 122, rather than the scan driver 151. In such an example embodiment, the compensation lines CL may be connected to the one of the elements 153, 123, and 122 described above instead of the scan driver 151. In addition, in such an example embodiment, a look-up table LUT may be connected to the one of the elements 153, 123, and 122 described above instead of the scan driver 151.

In some example embodiments, the first driving power line VDL in FIG. 8 may be individually connected to "i*j" number of pixels PX. To this end, the first driving power line VDL may include "i*j" number of first driving power lines VDL separated from each other. The "i*j" number of first driving power lines VDL are individually connected to the "i*j" number of pixels PX, respectively. In some example embodiments, the look-up table LUT in FIG. 8 provides information on the number of LEDs of each pixel PX to the power supplier 123. In some example embodiments, the power supplier 123 in FIG. 8 calculates the first driving voltage VDD of each pixel PX based on the number of LEDs of each pixel PX provided from the look-up table LUT, and applies the first driving voltage VDD to the pixels PX through the first driving power lines VDL, respectively. For example, the less the number of LEDs of the pixel PX, the lower the first driving voltage VDD applied to the pixel PX.

When the first driving power line VDL is individually connected to each pixel PX as described above, the compensation lines CL in FIG. 8 and the compensation switching element Trc in FIG. 9 are omitted. For example, each pixel PX may have the structure illustrated in FIG. 2. In addition, each pixel PX may have a structure in which the compensation lines CL1 and CL2 and the compensation switching elements Trc1 and Trc2 are omitted from FIGS. 10 to 13.

In another example embodiment, the second driving power line VSL in FIG. 8 may be individually connected to "i*j" number of pixels PX. To this end, the second driving power line VSL may include "i*j" number of second driving power lines VSL separated from each other. The "i*j" number of second driving power lines VSL are individually connected to the "i*j" number of pixels PX, respectively. In such an example embodiment, the look-up table LUT in FIG. 8 provides information on the number of LEDs of each pixel PX to the power supplier 123. In such an example embodiment, the power supplier 123 in FIG. 8 calculates the second driving voltage VSS of each pixel PX based on the number of LEDs of each pixel PX provided from the look-up table LUT, and applies the second driving voltage VSS to the pixels PX through the second driving power lines VSL, respectively. For example, the less the number of LEDs of the pixel PX, the lower the second driving voltage VSS applied to the pixel PX.

When the second driving power line VSL is individually connected to each pixel PX as described above, the compensation lines CL in FIG. 8 and the compensation switching element Trc in FIG. 9 are omitted. For example, each pixel PX may have the structure illustrated in FIG. 2. In addition, each pixel PX may have a structure in which the compensation lines CL1 and CL2 and the compensation switching elements Trc1 and Trc2 are omitted from FIGS. 10 to 13.

In another example embodiment, the first driving power line VDL and the second driving power line VSL in FIG. 8 may be individually connected to "i*j" number of pixels PX. To this end, the first driving power line VDL may include "i*j" number of first driving power lines VDL separated from each other, and the second driving power line VSL may include "i*j" number of second driving power lines VSL separated from each other. The "i*j" number of first driving power lines VDL are individually connected to the "i*j" number of pixels PX, respectively, and the "i*j" number of second driving power lines VSL are individually connected to the "i*j" number of pixels PX, respectively. In such an example embodiment, the look-up table LUT in FIG. 8 provides information on the number of LEDs of each pixel PX to the power supplier 123. In such an example embodiment, the power supplier 123 in FIG. 8 calculates the first and second driving voltages VDD and VSS of each pixel PX based on the number of LEDs of each pixel PX provided from the look-up table LUT, applies the first driving voltage VDD to the pixels PX through the first driving power lines VDL, respectively, and applies the second driving voltage VSS to the pixels PX through the second driving power lines VSL, respectively. For example, the less the number of LEDs of the pixel PX, the lower the levels of the first driving voltage VDD and the second driving voltage VSS applied to the pixel PX.

As set forth hereinabove, the display device according to one or more example embodiments of the present invention may provide the following effects.

First, the gray value of the image data signal of the pixel is compensated based on the number of LEDs of the pixel. Accordingly, pixels including different numbers of LEDs may emit light of the same color.

Second, a compensation voltage of the pixel is set based on the number of LEDs of the pixel. Accordingly, pixels including different numbers of LEDs may emit light of the same color.

While the present invention has been illustrated and described with reference to the embodiments thereof, it will be apparent to those of ordinary skill in the art that various changes in form and detail may be formed thereto without departing from the spirit and scope of the present invention, as defined in the following claims and their equivalents.

What is claimed is:

1. A display device comprising:

a display panel;

a pixel on the display panel, the pixel comprising at least one light emitting element;

a timing controller configured to receive an image data signal of the pixel and to compensate for a gray value of the image data signal based on a number of light emitting elements of the pixel to generate a compensated image data signal;

a data driver configured to select a compensation data signal corresponding to the compensated image data signal from the timing controller and to apply the compensation data signal to the pixel; and a look-up table in which the number of light emitting elements of the pixel is stored, the number of light emitting elements of the pixel being determined either via a photograph pixel or a current detected from the pixel, wherein the timing controller is configured to compare the number of light emitting elements of the pixel with a predetermined reference value, and to generate the compensated image data signal based on a comparison result.

2. The display device of claim 1, wherein, as the number of light emitting elements of the pixel is smaller, the compensated image data signal has a smaller gray value.

3. The display device of claim 2, wherein, when the number of light emitting elements of the pixel is less than the reference value, the compensated image data signal has a gray value less than that of the image data signal.

4. The display device of claim 3, wherein, as a difference between the number of light emitting elements of the pixel and the reference value is greater, the compensated image data signal has a smaller gray value.

5. The display device of claim 2, wherein, when the number of light emitting elements of the pixel is greater than the reference value, the compensated image data signal has a gray value greater than that of the image data signal.

6. The display device of claim 5, wherein, as a difference between the number of light emitting elements of the pixel and the reference value is greater, the compensated image data signal has a greater gray value.

7. The display device of claim 1, wherein at least one of the light emitting elements is a nano-light emitting element.

8. The display device of claim 1, wherein the compensation data signal from the data driver is applied to the pixel through a data line of the display panel.

9. The display device of claim 8, wherein the pixel comprises:

a first switching element comprising a gate electrode connected to a gate line of the display panel, the first switching element being connected between the data line and a node;

a second switching element comprising a gate electrode connected to the node, the second switching element being connected between a first driving power line of the display panel and a first electrode of the light emitting element; and a capacitor connected between the node and the first driving power line.

10. The display device of claim 9, wherein a second electrode of the light emitting element is connected to a second driving power line of the display panel.

11. A display device comprising:

a display panel comprising a pixel connected to a first driving power line, a second driving power line, a data line, and a first compensation line;

a driving circuit configured to generate a first compensation voltage based on a number of light emitting elements of the pixel, and to apply the first compensation voltage to the first compensation line; and a look-up table in which the number of light emitting elements of the pixel is stored, the number of light emitting elements of the pixel being determined either via a photograph of the pixel or a current detected from the pixel, wherein the pixel comprises:

a driving switching element configured to receive a data signal from the data line;

at least one light emitting element connected to the driving switching element; and a first compensation switching element comprising a gate electrode connected to the first compensation line, the first compensation switching element being connected between the first driving power line and the driving switching element, and wherein the driving circuit is configured to compare the number of light emitting elements of the pixel with a predetermined reference value, and to generate the first compensation voltage based on a comparison result.

12. The display device of claim 11, wherein, as the number of light emitting elements of the pixel is smaller, the first compensation voltage has a smaller value.

13. The display device of claim 12, wherein, when the number of light emitting elements of the pixel is less than the reference value, the first compensation voltage has a value less than that of a reference compensation voltage.

14. The display device of claim 13, wherein, as a difference between the number of light emitting elements of the pixel and the reference value is greater, the first compensation voltage has a smaller value.

15. The display device of claim 12, wherein, when the number of light emitting elements of the pixel is greater than the reference value, the first compensation voltage has a value greater than that of a predetermined reference compensation voltage.

16. A display device comprising:

a display panel comprising a pixel connected to a first driving power line, a second driving power line, a data line, and a first compensation line;

a driving circuit configured to generate a first compensation voltage based on a number of light emitting elements of the pixel, and to apply the first compensation voltage to the first compensation line; and a look-up table in which the number of light emitting elements of the pixel is stored, the number of light emitting elements of the pixel being determined either via a photograph of the pixel or a current detected from the pixel, wherein the pixel comprises:

a driving switching element configured to receive a data signal from the data line;

at least one light emitting element connected to the driving switching element; and a first compensation switching element comprising a gate electrode connected to the first compensation line, the first compensation switching element being connected between the light emitting element and the second driving power line, and wherein the driving circuit is configured to compare the number of light emitting elements of the pixel with a predetermined reference value, and to generate a compensated image data signal based on a comparison result.

17. The display device of claim 16, wherein, as the number of light emitting elements of the pixel is smaller, the first compensation voltage has a smaller value.

* * * * *